US008740429B2

(12) United States Patent
Okada et al.

(10) Patent No.: US 8,740,429 B2
(45) Date of Patent: Jun. 3, 2014

(54) VEHICULAR LAMP

(75) Inventors: Hidetaka Okada, Tokyo (JP); Takuya Matsumaru, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 270 days.

(21) Appl. No.: 13/305,734

(22) Filed: Nov. 28, 2011

(65) Prior Publication Data

US 2012/0155103 A1 Jun. 21, 2012

(30) Foreign Application Priority Data

Nov. 26, 2010 (JP) ..... 2010-264369

(51) Int. Cl.
*F21V 7/00* (2006.01)

(52) U.S. Cl.
USPC ..... 362/518; 362/299; 362/327; 362/336; 362/346; 362/522; 362/545

(58) Field of Classification Search
USPC ..... 362/296.01, 297–305, 311.02, 362/326–327, 332–340, 346–347, 516–518, 362/520–522, 543–545
See application file for complete search history.

(56) References Cited

U.S. PATENT DOCUMENTS 7,270,454 B2 9/2007 Amano
2010/0157616 A1* 6/2010 Nakada ..... 362/487

FOREIGN PATENT DOCUMENTS

JP 2005-203111 A 7/2005

* cited by examiner

*Primary Examiner* — Jason Moon Han
(74) *Attorney, Agent, or Firm* — Kenealy Vaidya LLP

(57) ABSTRACT

A vehicular lamp can include a guiding lens having a polygonal outline. The guiding lens can include divided portions around the optical axis with an equal center angle. The divided portions can each have an incidence face, a reflection face that can reflect to an optical axis direction light emitted from a light source and having passed through the incidence face, and a light-exiting face that can allow the light from the reflection face to pass therethrough to be projected in an illumination direction of the vehicular lamp. Each divided portion can have an outer-diameter end of the light-exiting face or reflection face at a position farthest from the optical axis within a plane including the maximum radius portion of the divided portion and the optical axis.

10 Claims, 17 Drawing Sheets

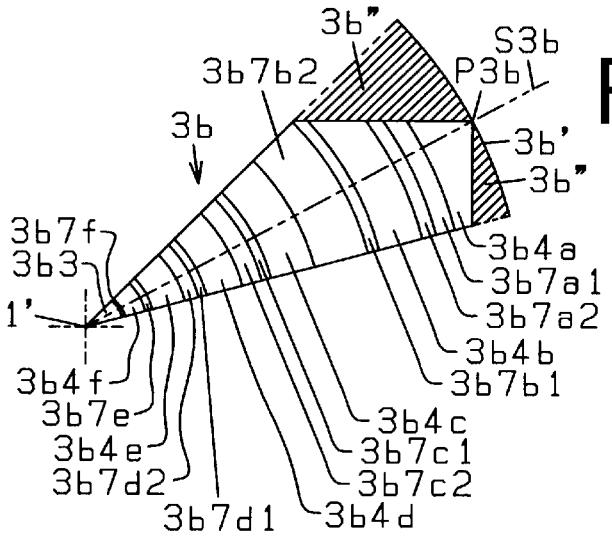
Fig. 3A
Fig. 3B
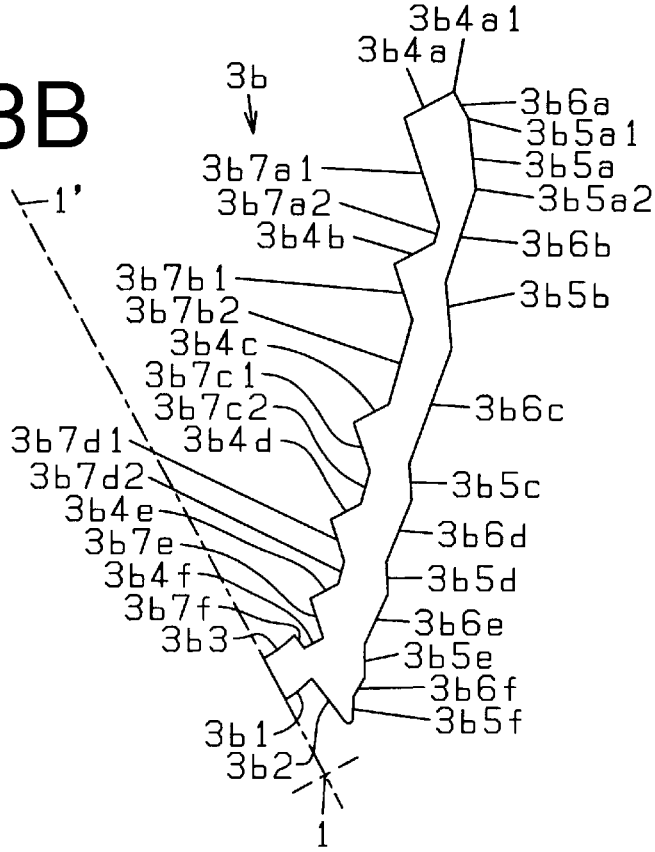

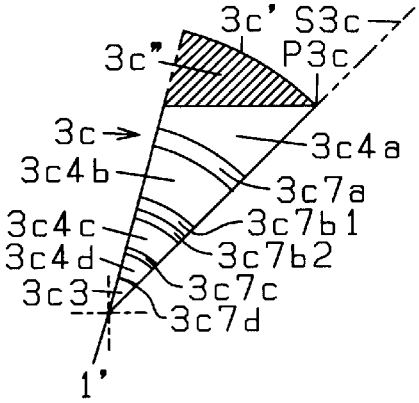
Fig. 4A
Fig. 4B
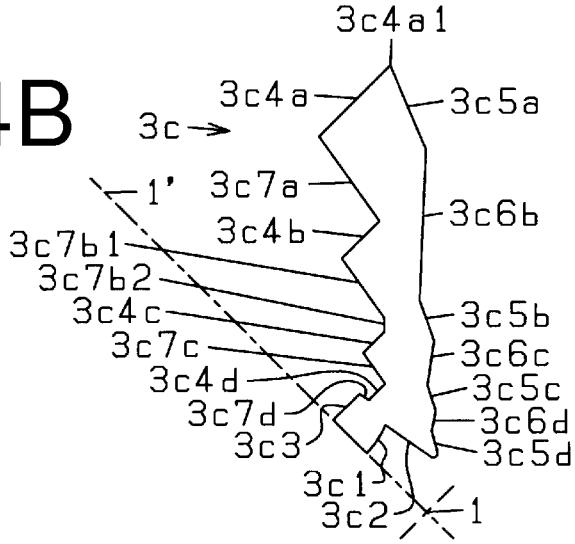

VEHICULAR LAMP

This application claims the priority benefit under 35 U.S.C. §119 of Japanese Patent Application No. 2010-264369 filed on Nov. 26, 2010, which is hereby incorporated in its entirety by reference.

TECHNICAL FIELD

The presently disclosed subject matter relates to a vehicular lamp having a light source including a light emitting device, and a guiding lens configured to guide light emitted from the light source. In particular, the presently disclosed subject matter relates to a vehicular lamp having a guiding lens with a contour, or outline, when viewed from an optical axis direction of the light source, to be a polygon having a center on the optical axis.

Furthermore, the presently disclosed subject matter relates to a vehicular lamp having a guiding lens of which the outline of a polygon can be clearly viewed when the guiding lens is viewed from the optical axis direction of the light source.

Still further, the presently disclosed subject matter relates to a vehicular lamp that can improve the use efficiency of light emitted from the light source.

BACKGROUND ART

Some conventional vehicular lamps have been known to include a light source with a light emitting device and a guiding lens (translucent member) configured to guide the light emitted from the light source. Examples of this type of vehicular lamp have been described in, for example, Japanese Patent Application Laid-Open No. 2005-203111 or U.S. Pat. No. 7,270,454(B2) (hereinafter, referred to as Patent Literature 1), in particular, FIGS. 1 to 3. The vehicular lamp disclosed in Patent Literature 1 has a light source having a light emitting device with an optical axis extending horizontally. Light emitted from the light source can be guided by the guiding lens (translucent member) to be partially radiated in the optical axis direction of the light source.

In particular, the vehicular lamp described in FIGS. 1 to 3 of Patent Literature 1 includes the guiding lens (translucent member) having: a first incidence face on which the light emitted from the light source at a first angle with respect to the optical axis of the light source is incident; a first light-exiting face through which the light from the first incidence face passes to be projected in the illumination direction of the vehicular lamp; a second incidence face on which the light emitted from the light source at a second angle larger than the first angle with respect to the optical axis and the light emitted from the light source at a third angle larger than the second angle with respect to the optical axis is incident; a first reflection face configured to reflect the light emitted from the light source at the second angle and having passed through the second incidence face, in the optical axis direction of the light source; a second light-exiting face through which the light from the first reflection face passes to be projected in the illumination direction of the vehicular lamp; a second reflection face configured to reflect the light emitted from the light source at the third angle and having passed through the second incidence face, in the optical axis direction of the light source; a third light-exiting face through which the light from the second reflection face passes to be projected in the illumination direction of the vehicular lamp; a reflection face-side connection face configured to connect the first reflection face with the second reflection face; and a light-exiting face-side connection face configured to connect the second light-exiting face with the third light-exiting face.

In the vehicular lamp disclosed in FIGS. 1 to 3 of Patent Literature 1, the outline of the guiding lens when viewed from the front side in the optical axis direction of the light source can be a circle. However, in order to enhance the aesthetic or designing value of a vehicular lamp, it may be required to form the guiding lens with a polygonal outline when viewed from the optical axis direction.

In order to comply with such a requirement, it is conceivable that such a guiding lens can be formed by the following designing process. Specifically, a rotational body for a guiding lens can be obtained by rotating a cross-section on a plane containing the optical axis of the light source around the optical axis by 360 degrees, and the rotational body is cut along a desired polygonal outline to obtain the desired guiding lens.

When a guiding lens is formed by the above designing process, however, light-exiting face-side connection faces configured to connect a plurality of light-exiting faces may be located on a plurality of sides of the polygon at a higher possibility rather than the light-exiting faces themselves are located thereon. Since the light-exiting face-side connection faces cannot be seen to emit light when viewed from the front side in the optical axis direction, if the light-exiting face-side connection faces are located on the polygon sides at a high possibility, the polygon sides of the guiding lens may be seen darker at a high possibility when viewed from the front side in the optical axis direction. Accordingly, when the guiding lens is designed by the above designing process, the resulting guiding lens may have a blurred outline of the polygon of the guiding lens when viewed from the front side in the optical axis direction.

Furthermore, this means that at the positions where the light-exiting face-side connection faces are located on the polygonal sides, there are no light-exiting faces configured to allow the light guided by the guiding lens to be projected therethrough in the illumination direction of the vehicular lamp. Accordingly, the light guided by the guiding lens to those positions cannot be projected in the illumination direction of the vehicular lamp. This may deteriorate the use efficiency of light emitted from the light source.

SUMMARY

The presently disclosed subject matter was devised in view of these and other problems and features and in association with the conventional art. According to an aspect of the presently disclosed subject matter, a vehicular lamp can be provided that can have a guiding lens with a clear outline of a polygon when viewed from the front side in the optical axis direction of the light source when compared with the case where the guiding lens is composed of a rotational body obtained by rotating a cross-sectional shape appearing on a plane containing the optical axis of the light source around the optical axis by 360 degrees, and cutting the body along a desired polygonal outline.

According to another aspect of the presently disclosed subject matter, a vehicular lamp can be provided that can enhance the use efficiency of light emitted from a light source when compared with the case where the guiding lens is composed of a rotational body obtained by rotating a cross-section on a plane containing the optical axis of the light source around the optical axis by 360 degrees, and cutting the body along a desired polygonal outline.

According to still another aspect of the presently disclosed subject matter, a vehicular lamp can include a light source having a light emitting device with an optical axis extending horizontally and a guiding lens configured to guide light emitted from the light source, wherein the light emitted from the light source can be guided by the guiding lens to be projected in a direction of the optical axis of the light source. The guiding lens can have a polygonal outline having N sides (where N is an integer greater than or equal to 3) when viewed from a front side in the direction of the optical axis of the light source, the polygonal outline centered around the optical axis of the light source. The guiding lens can be configured to include a plurality of divided portions obtained by virtually dividing the guiding lens with a plurality of planes containing the optical axis of the light source into n divided portions (where n is an integer larger than N), and setting center angles of the respective divided portions centered around the optical axis of the light source to 360/n degrees. Each of the divided portions of the guiding lens can be composed of part of a rotational body obtained by rotating a cross-sectional shape appearing on a plane containing the optical axis of the light source and a maximum radius portion of the divided portion farthest from the center around the optical axis by 360/n degrees. Each of the divided portions of the guiding lens can be configured to include:

a first incidence face on which the light emitted from the light source at a first angle with respect to the optical axis of the light source is incident;

a first light-exiting face through which the light from the first incidence face passes to be projected in the illumination direction of the vehicular lamp;

a second incidence face on which the light emitted from the light source at a second angle larger than the first angle with respect to the optical axis and the light emitted from the light source at a third angle larger than the second angle with respect to the optical axis is incident;

a first reflection face configured to reflect the light emitted from the light source at the second angle with respect to the optical axis and having passed through the second incidence face, in the direction of the optical axis of the light source;

a second light-exiting face through which the light from the first reflection face passes to be projected in the illumination direction of the vehicular lamp;

a second reflection face configured to reflect the light emitted from the light source at the third angle with respect to the optical axis and having passed through the second incidence face, in the direction of the optical axis of the light source;

a third light-exiting face through which the light from the second reflection face passes to be projected in the illumination direction of the vehicular lamp;

a reflection face-side connection face connecting the first reflection face with the second reflection face; and a light-exiting face-side connection face connecting the second light-exiting face with the third light-exiting face.

In this configuration, the second light-exiting face include an outer-diameter side end disposed at a farthest position from the optical axis of the light source in the plane containing the optical axis of the light source and the maximum radius portion of the corresponding divided portion.

In the vehicular lamp with the above configuration, when a first sector can be obtained by rotating a segment, connecting the maximum radius portion of a first divided portion out of the divided portions to the optical axis, perpendicular to the optical axis by 360/n degrees around the optical axis as a center, and a second sector can be obtained by rotating a segment, connecting the maximum radius portion of a second divided portion adjacent to the first divided portion to the optical axis, perpendicular to the optical axis by 360/n degrees around the optical axis as a center, if a difference area between the first sector and a projected area of the first divided portion when viewed from the front side in the direction of the optical axis is smaller than a difference area between the second sector and a projected area of the second divided portion when viewed from the front side in the direction of the optical axis, the first reflection face of the first divided portion and the first reflection face of the second divided portion can be configured such that a difference between a first angle and a second angle is smaller than a difference between a third angle and a fourth angle wherein the first angle is formed between the optical axis of the light source and the light impinging on an outer-diameter side end of the first reflection face of the first divided portion within the plane containing the maximum radius portion of the first divided portion and the optical axis of the light source, the second angle is formed between the optical axis of the light source and the light impinging on an inner-diameter side end of the first reflection face of the first divided portion within the plane containing the maximum radius portion of the first divided portion and the optical axis of the light source, the third angle is formed between the optical axis of the light source and the light impinging on an outer-diameter side end of the first reflection face of the second divided portion within the plane containing the maximum radius portion of the second divided portion and the optical axis of the light source, and the fourth angle is formed between the optical axis of the light source and the light impinging on an inner-diameter side end of the first reflection face of the second divided portion within the plane containing the maximum radius portion of the second divided portion and the optical axis of the light source.

In the vehicular lamp with the above configuration, the first incidence faces of the respective divided portions each can be formed from a rotational plane obtained by rotating a curve around the optical axis of the light source as a center by 360 degrees. Furthermore, the first light-exiting faces of the respective divided portions can be configured such that light emitted upward from the light source at an angle $\theta 1a$ (wherein $0<\theta 1a$) with respect to the optical axis of the light source can pass through the first incidence face and the first light-exiting face of one divided portion that is located at a position including a vertical plane containing the optical axis of the light source so that the exiting light becomes upward light at an angle $\theta 1b$ (wherein $0<\theta 1b<\theta 1a$) with respect to the optical axis of the light source, such that light emitted downward from the light source at the angle $\theta 1a$ with respect to the optical axis of the light source can pass through the first incidence face and the first light-exiting face of one divided portion that is located at a position including the vertical plane containing the optical axis of the light source so that the exiting light becomes downward light at the angle $\theta 1b$ with respect to the optical axis of the light source, such that light emitted rightward from the light source at the angle $\theta 1a$ with respect to the optical axis of the light source can pass through the first incidence face and the first light-exiting face of one divided portion that is located at a position including a horizontal plane containing the optical axis of the light source so that the exiting light becomes rightward light at an angle $\theta 1c$ (wherein $\theta 1b<\theta 1c$) with respect to the optical axis of the light source, and such that light emitted leftward from the light source at the angle $\theta 1a$ with respect to the optical axis of the light source can pass through the first incidence face and the first light-exiting face of one divided portion that is located at a position including the horizontal plane containing the optical axis of the light source so that the exiting light becomes leftward light at the angle θ1*c* with respect to the optical axis of the light source.

In the vehicular lamp with the above configuration, the divided portion that is located at the position within the horizontal plane containing the optical axis of the light source can be configured to include a third reflection face configured to reflect the light traveling from the second reflection face in the direction of the optical axis of the light source to guide the light at a certain angle with respect to the optical axis of the light source. In addition, part of the light from the third reflection face of the divided portion that is located at the position within the horizontal plane containing the optical axis of the light source can be allowed to pass through the third light-exiting face so that it becomes rightward or leftward light traveling within the horizontal plane at 45 degrees with respect to the optical axis of the light source.

As described above, the vehicular lamp according to one of the aspects of the presently disclosed subject matter can include a light source having a light emitting device and a guiding lens configured to guide light emitted from the light source. The optical axis of the light source can be disposed within the horizontal plane. Furthermore, the light emitted from the light source can be guided by the guiding lens, and part of the guided light can be projected in the optical axis direction of the light source.

Specifically, in the vehicular lamp according to the one of the aspects, the outline of the guiding lens of the vehicular lamp can be a polygon having N sides (where N is an integer greater than or equal to 3 when viewed from its front side in the optical axis direction. In this case, the polygon can be formed around the optical axis of the light source as a center. Further, the guiding lens can be configured to include n divided portions (blocks) virtually divided by a plurality of planes containing the optical axis, where n is an integer larger than N. The center angles of the respective divided portions around the optical axis can be set to 360/n degrees.

Further, in the vehicular lamp according to the one of the aspects, each of the divided portions can be composed of part of a rotational body obtained by rotating a cross-sectional shape around the optical axis by 360 degrees, with the cross-sectional shape appearing on a plane containing the optical axis and the maximum radius portion of the divided portion farthest from the center.

Furthermore, in the vehicular lamp according to the one of the aspects, each of the divided portions can be configured to include: a first incidence face on which the light emitted from the light source at a first angle with respect to the optical axis is incident; a first light-exiting face through which the light from the first incidence face passes to be projected in the illumination direction of the vehicular lamp; a second incidence face on which the light emitted from the light source at a second angle larger than the first angle with respect to the optical axis and the light emitted from the light source at a third angle larger than the second angle with respect to the optical axis is incident; a first reflection face configured to reflect the light emitted from the light source at the second angle and having passed through the second incidence face, in the optical axis direction; a second light-exiting face through which the light from the first reflection face passes to be projected in the illumination direction; a second reflection face configured to reflect the light emitted from the light source at the third angle and having passed through the second incidence face, in the optical axis direction; a third light-exiting face through which the light from the second reflection face passes to be projected in the illumination direction; a reflection face-side connection face configured to connect the first reflection face with the second reflection face; and a light-exiting face-side connection face configured to connect the second light-exiting face with the third light-exiting face.

Still further, in the vehicular lamp according to the one of the aspects, the outer-diameter side end of the second light-exiting face can be disposed at a farthest position from the optical axis in the plane containing the optical axis and the maximum radius portion of the corresponding divided portion.

Accordingly, when compared with the case where the guiding lens is composed of a rotational body obtained by rotating a cross-sectional shape appearing on a plane containing the optical axis of the light source around the optical axis by 360 degrees, and cutting the body along a desired polygonal outline, the second light-exiting faces of the vehicular lamp according to the one of the aspects can be disposed on the N sides of the polygon at a high possibility. In other words, the vehicular lamp according to one of the aspects can improve the ratio of the polygonal sides that can be seen to be bright when viewed from the front side in the optical axis direction when compared with the conventional vehicular lamp with the above configuration. This means that the guiding lens of the vehicular lamp can show a clear polygonal outline when viewed from the front side in the optical axis direction when compared with the conventional vehicular lamp with the above configuration.

Furthermore, when compared with the case where the guiding lens is composed of a rotational body obtained by rotating a cross-sectional shape appearing on a plane containing the optical axis of the light source around the optical axis by 360 degrees, and cutting the body along a desired polygonal outline, the vehicular lamp according to the one of the aspects can reduce the ratio of light that cannot be projected in the illumination direction of the vehicular lamp out of the light emitted from the light source and impinging on the guiding lens. Specifically, the vehicular lamp according to the one of the aspects can enhance the use efficiency of light emitted from the light source when compared with the conventional vehicular lamp with the above configuration.

In the vehicular lamp with the above configuration, suppose a case where a first sector is obtained by rotating a segment connecting the maximum radius portion of a first divided portion out of the divided portions to the optical axis perpendicular to the optical axis by (360/n) degrees around the optical axis as a center. Further, suppose that a second sector is obtained by rotating a segment connecting the maximum radius portion of a second divided portion adjacent to the first divided portion to the optical axis perpendicular to the optical axis by (360/n) degrees around the optical axis as a center. In this case, if a difference area between the first sector and a projected area of the first divided portion of the guiding lens when viewed from the front side in the optical axis direction is smaller than a difference area between the second sector and a projected area of the second divided portion of the guiding lens when viewed from the front side in the optical axis direction, the first reflection face of the first divided portion and the fist reflection face of the second divided portion can be configured such that the difference between a first angle and a second angle is smaller than the difference between a third angle and a fourth angle. Herein, the first angle is formed between the optical axis and the light impinging on an outer-diameter side end of the first reflection face of the first divided portion within the plane containing the maximum radius portion of the first divided portion and the optical axis. Furthermore, the second angle is formed between the optical axis and the light impinging on an inner-diameter side end of the first reflection face of the first divided portion within the plane containing the maximum radius portion of the first divided portion and the optical axis. Still further, the third angle is formed between the optical axis and the light impinging on an outer-diameter side end of the first reflection face of the second divided portion within the plane containing the maximum radius portion of the second divided portion and the optical axis. Furthermore, the fourth angle is formed between the optical axis and the light impinging on an inner-diameter side end of the first reflection face of the second divided portion within a plane containing the maximum radius portion of the second divided portion and the optical axis.

If the first reflection face of the first divided portion and the first reflection face of the second divided portion are configured such that the difference between the first and second angles is equal to the difference between the third and fourth angles, the light that passes through the second light-exiting face of the second divided portion and is reflected by the first reflection face of the second divided portion in the illuminating direction of the vehicular lamp can be seen darker than the light that passes through the second light-exiting face of the first divided portion and is reflected by the first reflection face of the first divided portion in the illuminating direction of the vehicular lamp. However, the vehicular lamp with the above configuration can avoid such a phenomenon.

Namely, when compared with the case where the first reflection face of the first divided portion and the first reflection face of the second divided portion are configured such that the difference between the first and second angles is equal to the difference between the third and fourth angles, the respective sides of the polygon when viewed from the optical axis direction of the light source can be observed to be illuminated with a uniform brightness.

In the vehicular lamp with the above configuration, the first incidence faces of the respective divided portions can be formed from a rotational plane obtained by rotating a curve around the optical axis of the light source as a center by 360 degrees.

Furthermore, the first light-exiting faces of the respective divided portions can be configured as follows. Namely with this configuration, the light emitted upward from the light source at an angle $\theta 1a$ (wherein $0<\theta 1a$) with respect to the optical axis can pass through the first incidence face and the first light-exiting face of one divided portion that is located at a position including a vertical plane containing the optical axis of the light source, so that the exiting light becomes upward light at an angle $\theta 1b$ (wherein $0<\theta 1b<\theta 1a$) with respect to the optical axis. Further, the light emitted downward from the light source at the angle $\theta 1a$ can pass through the first incidence face and the first light-exiting face of one divided portion that is located at a position including the vertical plane containing the optical axis, so that the exiting light becomes downward light at the angle $\theta 1b$ with respect to the optical axis. Still further, the light emitted rightward from the light source at the angle $\theta 1a$ can pass through the first incidence face and the first light-exiting face of one divided portion that is located at a position including a horizontal plane containing the optical axis, so that the exiting light becomes rightward light at an angle $\theta 1c$ (wherein $\theta 1b<\theta 1c$) with respect to the optical axis. Still further, the light emitted leftward from the light source at the angle $\theta 1a$ can pass through the first incidence face and the first light-exiting face of one divided portion that is located at a position including the horizontal plane containing the optical axis, so that the exiting light becomes leftward light at the angle $\theta 1c$ with respect to the optical axis.

Accordingly, in the above vehicular lamp, the light projected from the respective divided portions of the guiding lens through the respective first light-exiting faces in the illumination direction of the vehicular lamp can form a light distribution pattern (P) horizontally long.

In the vehicular lamp with the above configuration, the divided portion that is located at the position including the horizontal plane containing the optical axis can include a third reflection face configured to reflect the light traveling from the second reflection face in the optical axis direction to guide the light at a certain angle with respect to the optical axis.

In addition, part of the light from the third reflection face of the divided portion that is located at a position within the horizontal plane containing the optical axis can be allowed to pass through the third light-exiting face, so that the light becomes rightward or leftward light traveling within the horizontal plane at 45 degrees with respect to the optical axis.

With this configuration, when the vehicular lamp is observed at a position that is on the extension of 45-degree line with respect to the optical axis, the third light-exiting faces of the divided portions located at the position within the horizontal plane containing the optical axis can be observed as if they are illuminated brighter.

BRIEF DESCRIPTION OF DRAWINGS

These and other characteristics, features, and advantages of the presently disclosed subject matter will become clear from the following description with reference to the accompanying drawings, wherein:

FIG. 3A is a front view of another part (right corner) of the guiding lens of the vehicular lamp according to the first exemplary embodiment and FIG. 3B is a cross-sectional view of the part of the guiding lens of FIG. 3A;

FIG. 4A is a front view of another part (right upper side) of the guiding lens of the vehicular lamp according to the first exemplary embodiment and FIG. 4B is a cross-sectional view of the part of the guiding lens of FIG. 4A;

DESCRIPTION OF EXEMPLARY EMBODIMENTS

A description will now be made below to vehicular lamps of the presently disclosed subject matter with reference to the accompanying drawings in accordance with exemplary embodiments.

Figure 1A:
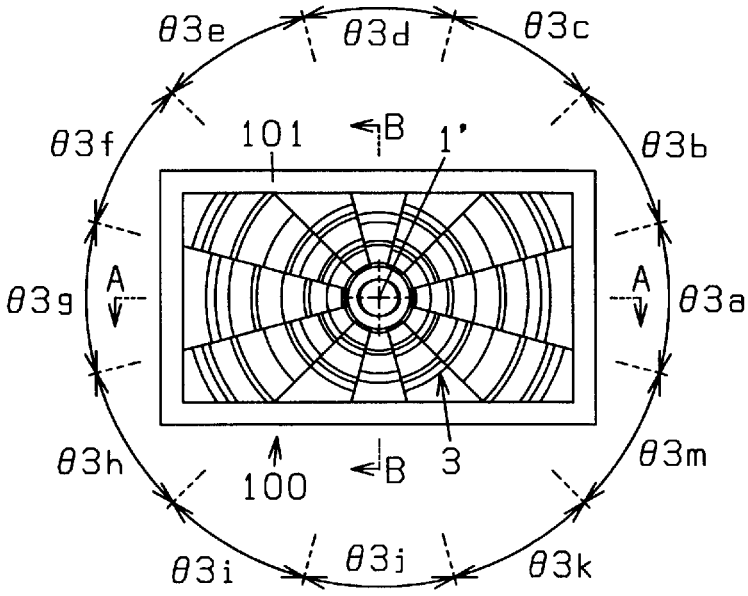
FIGS. 1A, 1B, and 1C are a front view of a vehicular lamp according to a first exemplary embodiment made in accordance with principles of the presently disclosed subject matter, a horizontal cross-sectional view taken along line A-A in FIG. 1A, and a vertical cross-sectional view taken along line B-B in FIG. 1A, respectively.
Figure 1B:
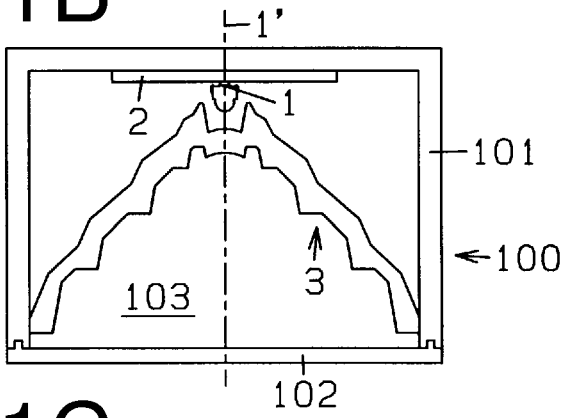
Figure 1C:
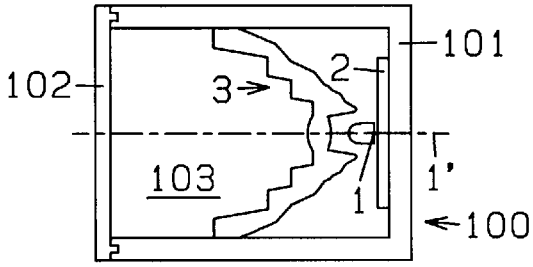

FIG. 1A to 1C schematically show a vehicular lamp 100 according to a first exemplary embodiment. Specifically, FIGS. 1A, 1B, and 1C are a front view of the vehicular lamp 100 according to the first exemplary embodiment made in accordance with principles of the presently disclosed subject matter, a horizontal cross-sectional view taken along line A-A in FIG. 1A including the optical axis 1' of a light source 1, and a vertical cross-sectional view taken along line B-B in FIG. 1A including the optical axis 1' of the light source 1, respectively.

Figure 2A:
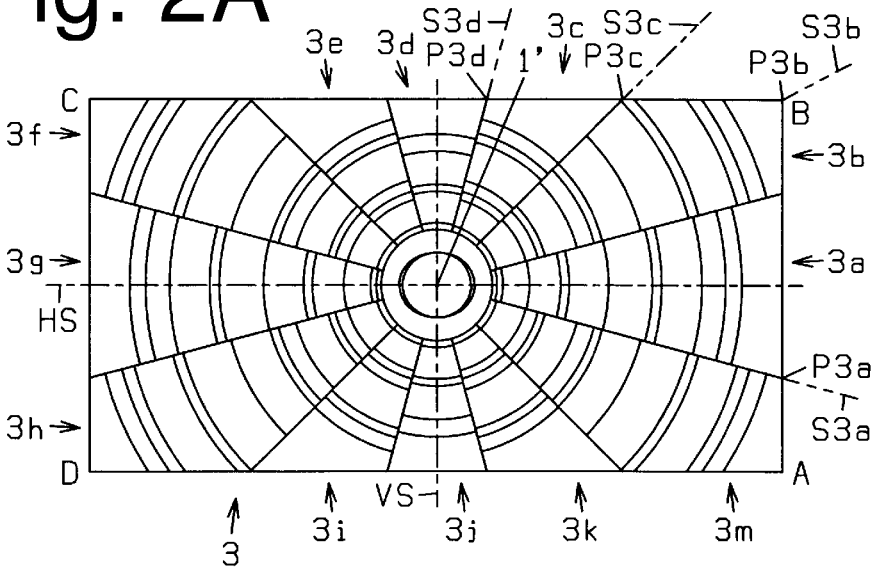
FIG. 2A is a front view of a guiding lens of the vehicular lamp according to the first exemplary embodiment.
Figure 5A:
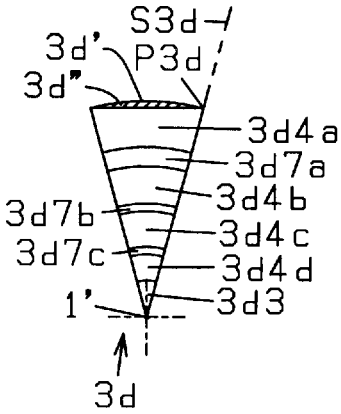
FIG. 5A is a front view of another part (upper side) of the guiding lens of the vehicular lamp according to the first exemplary embodiment and FIG. 5B is a cross-sectional view of the part of the guiding lens of FIG. 5A.
Figure 5B:
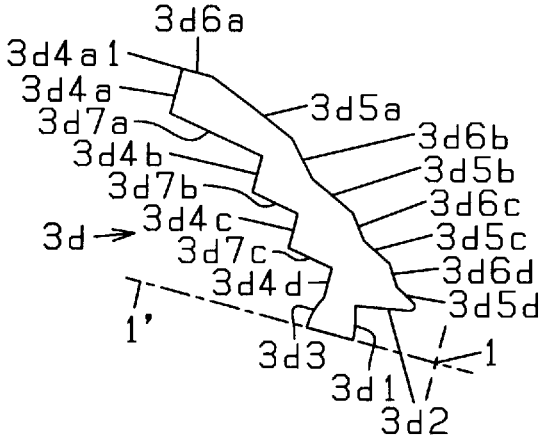

FIGS. 2A to 5B illustrate a guiding lens 3 constituting the vehicular lamp 100 according to the first exemplary embodiment. Specifically, FIG. 2A is a front view of the guiding lens 3 of the vehicular lamp 100. FIG. 2B is a front view of part (a right side divided portion 3*a*) of the guiding lens 3. FIG. 2C is a cross-sectional view of the divided portion 3*a* within a plane S3*a* including a maximum radius portion P3*a* farthest from the optical axis 1' of the light source 1 and the optical axis 1'. FIG. 3A is a front view of another part (a right corner divided portion 3*b*) of the guiding lens 3. FIG. 3B is a cross-sectional view of the divided portion 3*b* within a plane S3*b* including a maximum radius portion P3*b* farthest from the optical axis 1' of the light source 1 and the optical axis 1'. FIG. 4A is a front view of another part (a right upper divided portion 3*c*) of the guiding lens 3. FIG. 4B is a cross-sectional view of the divided portion 3*c* within a plane S3*c* including a maximum radius portion P3*c* farthest from the optical axis 1' of the light source 1 and the optical axis 1'. FIG. 5A is a front view of another part (an upper divided portion 3*d*) of the guiding lens 3. FIG. 5B is a cross-sectional view of the divided portion 3*d* within a plane S3*d* including a maximum radius portion P3*d* farthest from the optical axis 1' of the light source 1 and the optical axis 1'.

Figure 2B:
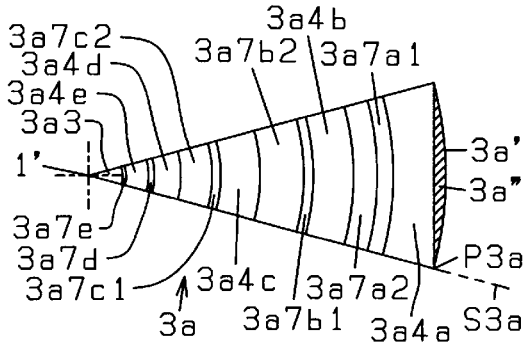
FIG. 2B is a front view of part (right side) of the guiding lens of FIG. 2A
Figure 2C:
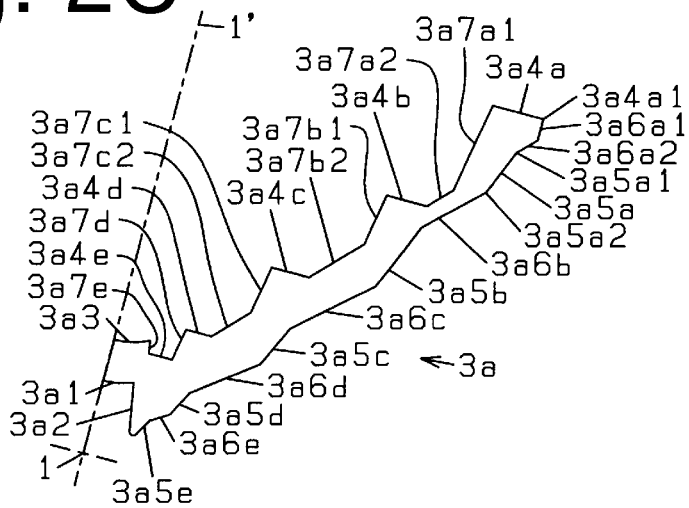
FIG. 2C is a cross-sectional view of the part of the guiding lens of FIG. 2B.
Figure 6A:
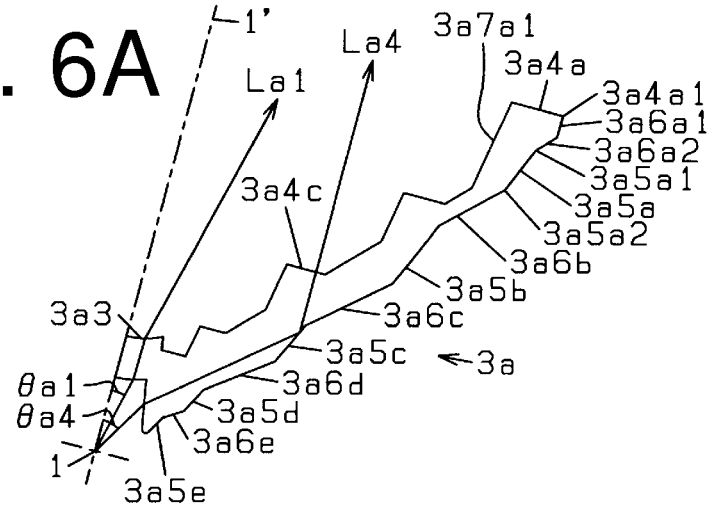
FIGS. 6A, 6B, and 6C show the paths of light emitted from the light source and guided by the guiding lens part shown in the cross-section of FIG. 2C.
Figure 6B:
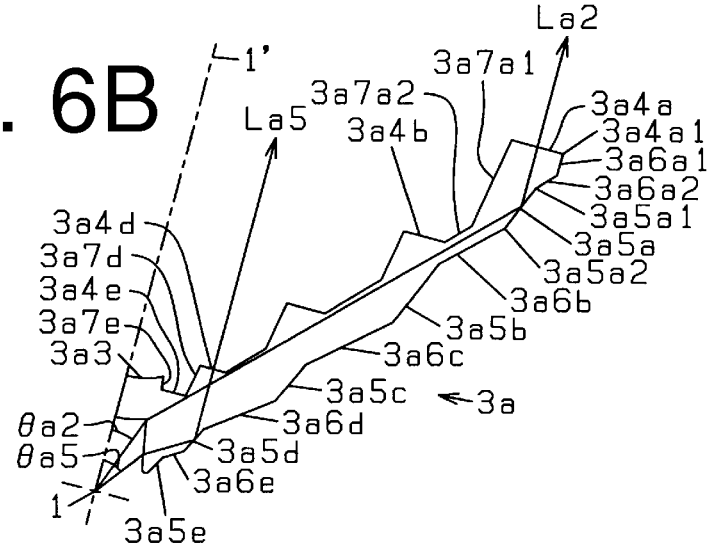
Figure 6C:
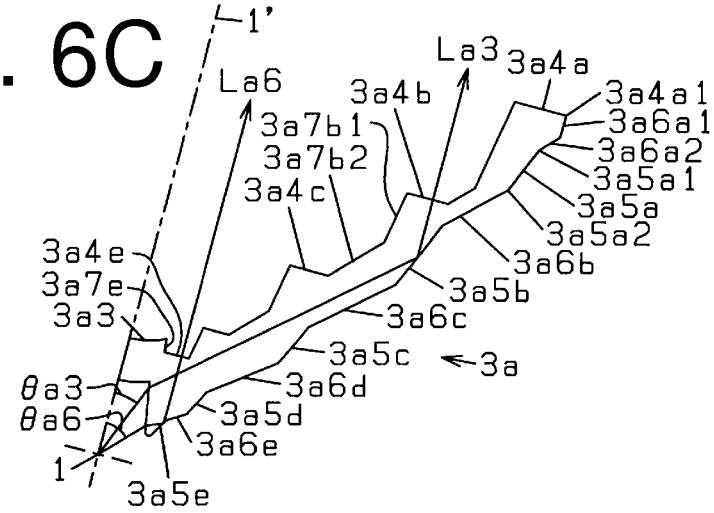
Figure 9A:
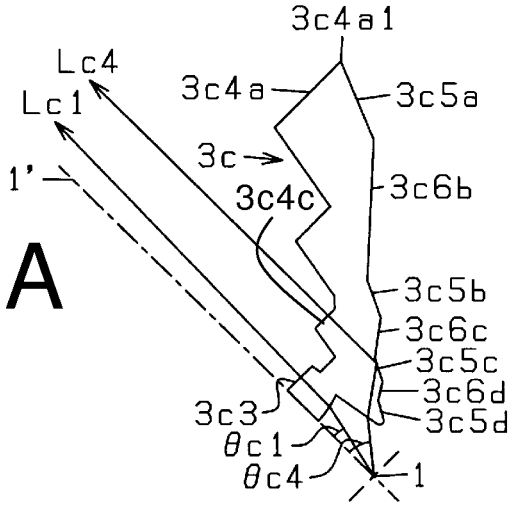
FIGS. 9A, 9B, and 9C show paths of light emitted from the light source and guided by the guiding lens part shown in the cross-section of FIG. 4B.
Figure 9B:
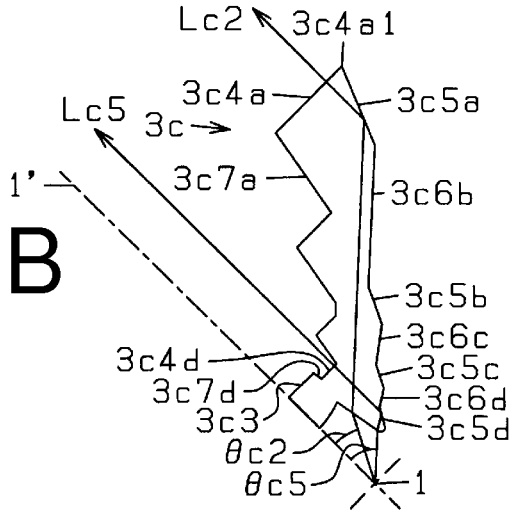
Figure 9C:
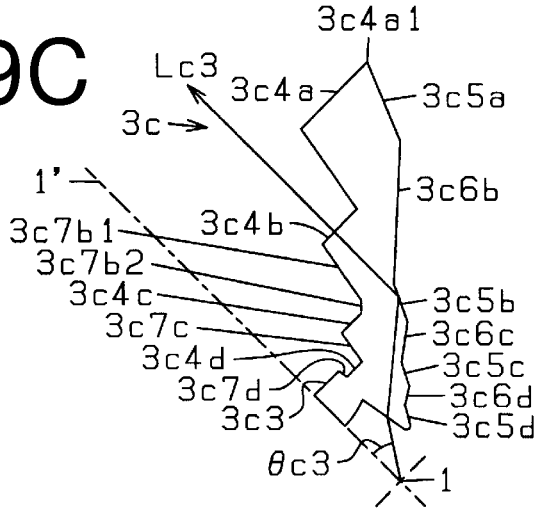
Figure 10A:
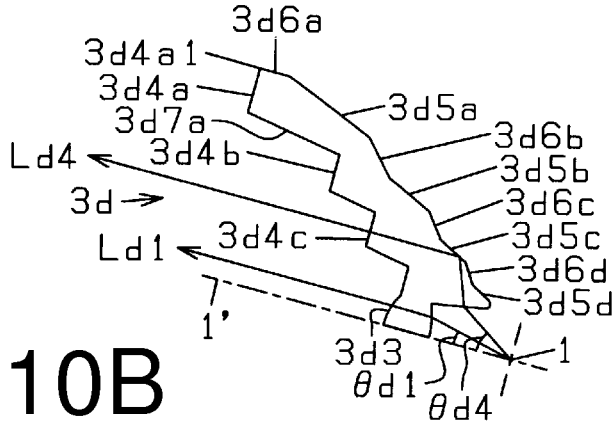
FIGS. 10A, 10B, and 10C show paths of light emitted from the light source and guided by the guiding lens part shown in cross-section of FIG. 5B.
Figure 10B:
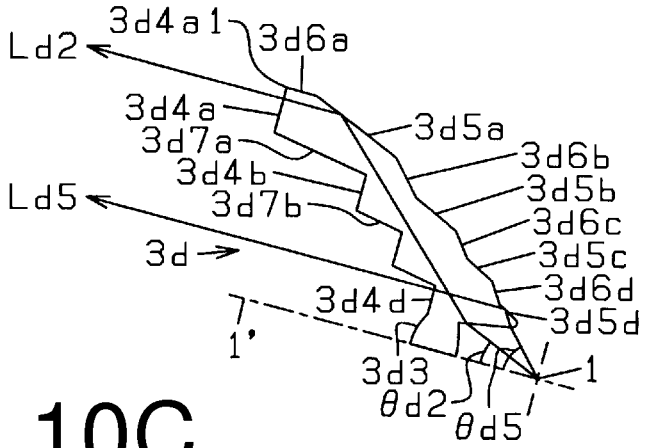
Figure 10C:
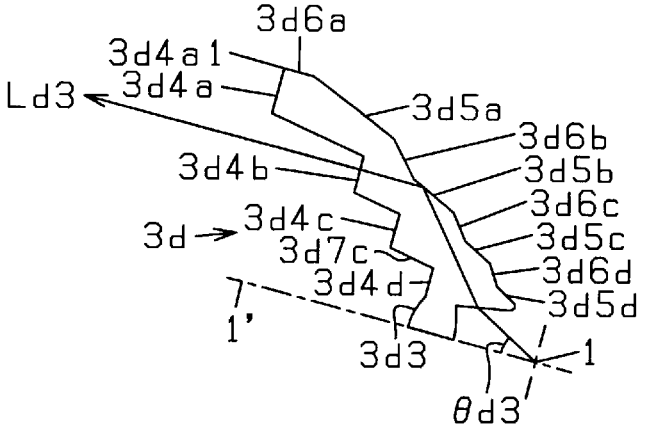

FIGS. 6A, 6B, and 6C show the paths La1, La2, La3, La4, La5, and La6 of light emitted from the light source 1 and guided by the divided portion 3*a* of the guiding lens 3 shown in the cross-section of FIG. 2C. FIGS. 7A and 7B and 8A and 8B show the paths Lb1, Lb2, Lb3, Lb4, Lb5, and Lb6 of light emitted from the light source 1 and guided by the divided portion 3*b* of the guiding lens 3 shown in the cross-section of FIG. 3B. FIGS. 9A, 9B, and 9C show the paths Lc1, Lc2, Lc3, Lc4, and Lc5 of light emitted from the light source 1 and guided by the divided portion 3*c* of the guiding lens 3 shown in the cross-section of FIG. 4B. FIGS. 10A, 10B, and 10C show the paths Ld1, Ld2, Ld3, Ld4, and Ld5 of light emitted from the light source 1 and guided by the divided portion 3*d* of the guiding lens 3 shown in the cross-section of FIG. 5B.

Figure 11A:
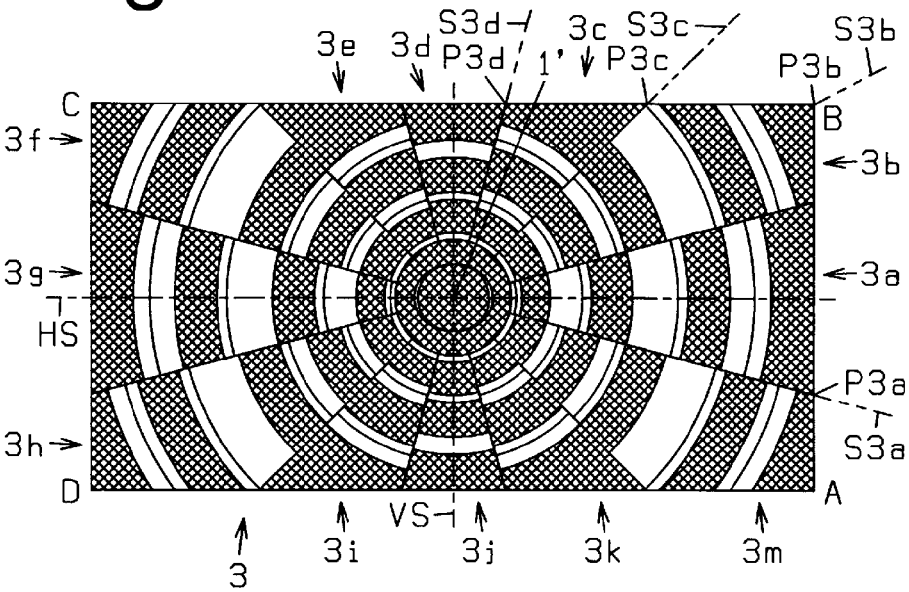
FIG. 11A is a front view of the guiding lens of the vehicular lamp according to the first exemplary embodiment and FIG. 11B is a front view of a conventional guiding lens including a virtual portion around the guiding lens where the brighter portions when the vehicular lamp is lit are cross-hatched.
Figure 11B:
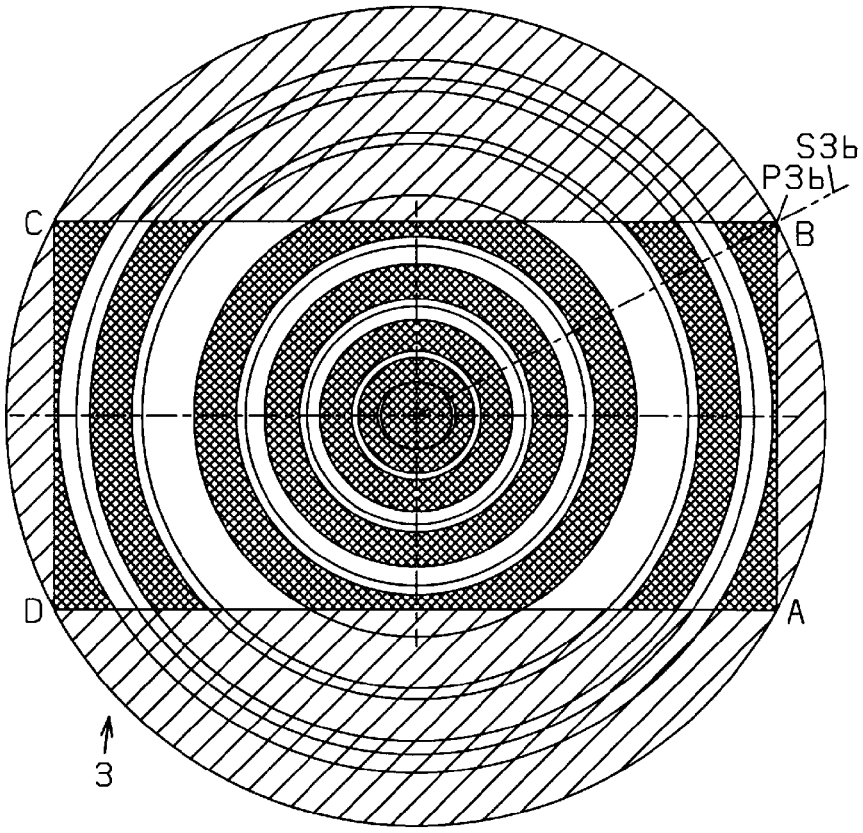
Fig. 11B Conventional Art

FIG. 11A is a front view of the guiding lens 3 of the vehicular lamp according to the first exemplary embodiment when viewed in the direction of the optical axis 1' of the light source 1 where the brighter portions are cross-hatched when the vehicular lamp is lit. FIG. 11B is a front view of a conventional guiding lens 903 including a virtual portion around the guiding lens 903 where the brighter portions (when the vehicular lamp is lit) are cross-hatched. Specifically, the guiding lens 903 is composed of a part of a rotational body obtained by rotating a cross-sectional shape appearing on a plane containing the optical axis of the light source around the optical axis by 360 degrees, and cutting the body along a desired polygonal outline (rectangle in the illustrated example) and removing the virtual portion (hatched portion) in the drawing.

As shown in FIGS. 1A-1C, the vehicular lamp 100 of the first exemplary embodiment can include the light source 1 including a light emitting device such as an LED light source mounted on a substrate 2 (see FIGS. 1B and 1C), the guiding lens 3 configured to guide the light from the light source 1, a housing 101, and a cover lens 102. The light source 1 and the guiding lens 3 can be housed within a lamp chamber 103 defined by the housing 101 and the cover lens 102. The optical axis 1' of the light source 1 is disposed in a horizontal plane. It should be noted that in the present description the upper, lower, right, left, front, and rear directions are based on the state where the vehicular lamp 100 is mounted in a vehicle body in a typical manner, unless otherwise specified.

In the vehicular lamp 100 of the first exemplary embodiment as shown in FIG. 2A, the guiding lens 3 can have a rectangular front shape as a polygonal shape when viewed in the optical axis 1' direction of the light source 1 (from the lower side of FIG. 1B and from the left side of FIG. 1C) with four sides AB, BC, CD, and DA and having a center at the optical axis 1'. The guiding lens 3 can have a plurality of divided portions (12 in the illustrated example) 3*a*, 3*b*, 3*c*, 3*d*, 3*e*, 3*f*, 3*g*, 3*h*, 3*i*, 3*j*, 3*k*, and 3*m* virtually divided by a plurality of planes including the optical axis 1' of the light source 1. Further, as shown in FIGS. 1A and 2A, the respective divided portions 3*a*, 3*b*, 3*c*, 3*d*, 3*e*, 3*f*, 3*g*, 3*h*, 3*i*, 3*j*, 3*k*, and 3*m* can have respective center angles θ3*a*, θ3*b*, θ3*c*, θ3*d*, θ3*e*, θ3*f*, θ3*g*, θ3*h*, θ3*i*, θ3*j*, θ3*k*, and θ3*m* around the optical axis 1' of the light source 1, where the angle can be set to 30 degrees, for example. Each divided portion 3*a*, 3*b*, 3*c*, 3*d*, 3*e*, 3*f*, 3*g*, 3*h*, 3*i*, 3*j*, 3*k*, and 3*m* including a first demarcation extending radially from the optical axis and a second demarcation extending radially from the optical axis at the respective center angle θ3*a*, θ3*b*, θ3*c*, θ3*d*, θ3*e*, θ3*f*, θ3*g*, θ3*h*, θ3*i*, θ3*j*, θ3*k*, and θ3*m*. The second demarcation abuts the first demarcation of the adjacent divided portion 3*a*, 3*b*, 3*c*, 3*d*, 3*e*, 3*f*, 3*g*, 3*h*, 3*i*, 3*j*, 3*k*, and 3*m*.

Specifically, in the vehicular lamp 100 of the first exemplary embodiment, as shown in FIGS. 2B and 2C, the divided portion 3*a* can be prepared in the following manner. Namely, a cross-sectional shape (see FIG. 2C) appearing on a plane S3*a* (see FIG. 2B) containing the optical axis 1' of the light source 1 and the maximum radius portion P3*a* (see FIG. 2B) of the divided portion 3*a* farthest from the optical axis 1' (or the center of the guiding lens 3) can be rotated around the optical axis 1' by 30 degrees to form a rotational body 3*a*' of sector shape (see FIG. 2B) as a basic block. The basic block or the rotational body 3*a*' can be cut along the side AB of the rectangle (see FIG. 2A) so that the excess portion 3*a*" over the outline of the rectangle (see FIG. 2B) is removed, thereby forming the divided portion 3*a*.

Furthermore, in the vehicular lamp 100 of the first exemplary embodiment, as shown in FIG. 6A, the divided portion 3*a* of the guiding lens 3 can include an incidence face 3*a*1 (see FIG. 2C) on which light emitted from the light source 1 at an angle θa1 with respect to the optical axis 1' of the light source 1 is incident and a light-exiting face 3*a*3 through which the light from the incidence face 3*a*1 passes to be projected in the illumination direction of the vehicular lamp 100 (right upper side of FIG. 6A). Specifically, in the vehicular lamp 100 of the first exemplary embodiment, as shown in FIG. 6A, the light La1 that is emitted from the light source 1 at the angle θa1 with respect to the optical axis 1' and passes through the incidence face 3*a*1 and the light-exiting face 3*a*3 of the divided portion 3*a* can be projected in the illumination direction of the vehicular lamp 100 (right upper side of FIG. 6A).

In the vehicular lamp 100 of the first exemplary embodiment, as shown in FIGS. 6A to 6C, the divided portion 3*a* of the guiding lens 3 (see FIG. 2A) can further include an incidence face 3*a*2 (see FIG. 2C) on which light emitted from the light source 1 at angles θa2, θa3, θa4, θa5, and θa6 with respect to the optical axis 1' (wherein θa1<θa2<θa3<θa4<θa5<θa6) is incident.

In the vehicular lamp 100 of the first exemplary embodiment, as shown in FIG. 6B, the divided portion 3*a* of the guiding lens 3 (see FIG. 2A) can further include a reflection face 3*a*5*a* configured to reflect the light emitted from the light source 1 at the angle θa2 with respect to the optical axis 1' and having passed through the incidence face 3*a*2 (see FIG. 2C), in the optical axis direction and a light-exiting face 3*a*4*a* through which the light from the reflection face 3*a*5*a* passes to be projected in the illumination direction of the vehicular lamp 100 (right upper side of FIG. 6B). Specifically, in the vehicular lamp 100 of the first exemplary embodiment, as shown in FIG. 6B, the light La2 that is emitted from the light source 1 at the angle θa2 with respect to the optical axis 1' and passes through the incidence face 3*a*2 of the divided portion 3*a*, is reflected by the reflection face 3*a*5*a*, and passes through the light-exiting face 3*a*4*a* can be projected as parallel light in the illumination direction of the vehicular lamp 100 (right upper side of FIG. 6B). Specifically, in the vehicular lamp 100 of the first exemplary embodiment, the light-exiting face 3*a*4*a* of the divided portion 3*a* can be configured such that almost all the light passing through the light-exiting face 3*a*4*a* can become parallel with the optical axis 1' of the light source 1.

In the vehicular lamp 100 of the first exemplary embodiment, as shown in FIG. 6C, the divided portion 3*a* of the guiding lens 3 (see FIG. 2A) can further include a reflection face 3*a*5*b* configured to reflect the light emitted from the light source 1 at the angle θa3 with respect to the optical axis 1' and having passed through the incidence face 3*a*2 (see FIG. 2C), in the optical axis direction and a light-exiting face 3*a*4*b* through which the light from the reflection face 3*a*5*b* passes to be projected in the illumination direction of the vehicular lamp 100 (right upper side of FIG. 6C). Specifically, in the vehicular lamp 100 of the first exemplary embodiment, as shown in FIG. 6C, the light La3 that is emitted from the light source 1 at the angle θa3 with respect to the optical axis 1' and passes through the incidence face 3*a*2 of the divided portion 3*a*, is reflected by the reflection face 3*a*5*b*, and passes through the light-exiting face 3*a*4*b* can be projected as parallel light in the illumination direction of the vehicular lamp 100 (right upper side of FIG. 6C). Specifically, in the vehicular lamp 100 of the first exemplary embodiment, the light-exiting face 3*a*4*b* of the divided portion 3*a* can be configured such that almost all the light passing through the light-exiting face 3*a*4*b* can become parallel with the optical axis 1' of the light source 1. In one modified example of the vehicular lamp 100 of the first exemplary embodiment, the light-exiting face 3*a*4*b* of the divided portion 3*a* can be configured such that part of the light passing through the light-exiting face 3*a*4*b* can become parallel with the optical axis 1' and the remaining part of the light passing through the light-exiting face 3*a*4*b* can become light travelling at a certain angle with respect to the optical axis 1'. In another modified example of the vehicular lamp 100 of the first exemplary embodiment, the light-exiting face 3*a*4*b* of the divided portion 3*a* can be configured such that all the light passing through the light-exiting face 3*a*4*b* can become light travelling at a certain angle with respect to the optical axis 1'.

In the vehicular lamp 100 of the first exemplary embodiment, as shown in FIG. 6A, the divided portion 3*a* of the guiding lens 3 (see FIG. 2A) can further include a reflection face 3*a*5*c* configured to reflect the light emitted from the light source 1 at the angle θa4 with respect to the optical axis 1' and having passed through the incidence face 3*a*2 (see FIG. 2C), in the optical axis direction and a light-exiting face 3*a*4*c* through which the light from the reflection face 3*a*5*c* passes to be projected in the illumination direction of the vehicular lamp 100 (right upper side of FIG. 6A). Specifically, in the vehicular lamp 100 of the first exemplary embodiment, as shown in FIG. 6A, the light La4 that is emitted from the light source 1 at the angle θa4 with respect to the optical axis 1' and passes through the incidence face 3*a*2 of the divided portion 3*a*, is reflected by the reflection face 3*a*5*c*, and passes through the light-exiting face 3*a*4*c* can be projected as parallel light in the illumination direction of the vehicular lamp 100 (right upper side of FIG. 6A). Specifically, in the vehicular lamp 100 of the first exemplary embodiment, the light-exiting face 3*a*4*c* of the divided portion 3*a* can be configured such that almost all the light passing through the light-exiting face 3*a*4*c* can become parallel with the optical axis 1' of the light source 1.

In one modified example of the vehicular lamp 100 of the first exemplary embodiment, the light-exiting face 3*a*4*c* of the divided portion 3*a* can be configured such that part of the light passing through the light-exiting face 3*a*4*c* can become parallel with the optical axis 1' and the remaining part of the light passing through the light-exiting face 3*a*4*c* can become light travelling at a certain angle with respect to the optical axis 1'. In another modified example of the vehicular lamp 100 of the first exemplary embodiment, the light-exiting face 3*a*4*c* of the divided portion 3*a* can be configured such that all the light passing through the light-exiting face 3*a*4*c* can become light travelling at a certain angle with respect to the optical axis 1'.

In the vehicular lamp 100 of the first exemplary embodiment, as shown in FIG. 6B, the divided portion 3*a* of the guiding lens 3 (see FIG. 2A) can further include a reflection face 3*a*5*d* configured to reflect the light emitted from the light source 1 at the angle θa5 with respect to the optical axis 1' and passing through the incidence face 3*a*2 (see FIG. 2C), in the optical axis direction and a light-exiting face 3*a*4*d* through which the light from the reflection face 3*a*5*d* passes to be projected in the illumination direction of the vehicular lamp 100 (right upper side of FIG. 6B). Specifically, in the vehicular lamp 100 of the first exemplary embodiment, as shown in FIG. 6B, the light La5 that is emitted from the light source 1 at the angle θa5 with respect to the optical axis 1' and passes through the incidence face 3*a*2 of the divided portion 3*a*, is reflected by the reflection face 3*a*5*d*, and passes through the light-exiting face 3*a*4*d* can be projected as parallel light in the illumination direction of the vehicular lamp 100 (right upper side of FIG. 6B). Specifically, in the vehicular lamp 100 of the first exemplary embodiment, the light-exiting face 3*a*4*d* of the divided portion 3*a* can be configured such that almost all the light passing through the light-exiting face 3*a*4*d* can become parallel with the optical axis 1' of the light source 1. In one modified example of the vehicular lamp 100 of the first exemplary embodiment, the light-exiting face 3*a*4*d* of the divided portion 3*a* can be configured such that part of the light passing through the light-exiting face 3*a*4*d* can become parallel with the optical axis 1' and the remaining part of the light passing through the light-exiting face 3*a*4*d* can become light travelling at a certain angle with respect to the optical axis 1'. In another modified example of the vehicular lamp 100 of the first exemplary embodiment, the light-exiting face 3*a*4*d* of the divided portion 3*a* can be configured such that all the light passing through the light-exiting face 3*a*4*d* can become light travelling at a certain angle with respect to the optical axis 1'.

In the vehicular lamp 100 of the first exemplary embodiment, as shown in FIG. 6C, the divided portion 3*a* of the guiding lens 3 (see FIG. 2A) can further include a reflection face 3*a*5*e* configured to reflect the light emitted from the light source 1 at the angle θa6 with respect to the optical axis 1' and having passed through the incidence face 3*a*2 (see FIG. 2C), in the optical axis direction and a light-exiting face 3*a*4*e* through which the light from the reflection face 3*a*5*e* passes to be projected in the illumination direction of the vehicular lamp 100 (right upper side of FIG. 6C). Specifically, in the vehicular lamp 100 of the first exemplary embodiment, as shown in FIG. 6C, the light La6 that is emitted from the light source 1 at the angle θa6 with respect to the optical axis 1' and passes through the incidence face 3*a*2 of the divided portion 3*a*, is reflected by the reflection face 3*a*5*e*, and passes through the light-exiting face 3*a*4*e* can be projected as parallel light in the illumination direction of the vehicular lamp 100 (right upper side of FIG. 6C). Specifically, in the vehicular lamp 100 of the first exemplary embodiment, the light-exiting face 3*a*4*e* of the divided portion 3*a* can be configured such that almost all the light passing through the light-exiting face 3*a*4*e* can become parallel with the optical axis 1' of the light source 1. In one modified example of the vehicular lamp 100 of the first exemplary embodiment, the light-exiting face 3*a*4*e* of the divided portion 3*a* can be configured such that part of the light passing through the light-exiting face 3*a*4*e* can become parallel with the optical axis 1' and the remaining part of the light passing through the light-exiting face 3*a*4*e* can become light travelling at a certain angle with respect to the optical axis 1'. In another modified example of the vehicular lamp 100 of the first exemplary embodiment, the light-exiting face 3*a*4*e* of the divided portion 3*a* can be configured such that all the light passing through the light-exiting face 3*a*4*e* can become light travelling at a certain angle with respect to the optical axis 1'.

In the vehicular lamp 100 of the first exemplary embodiment, as shown in FIG. 2C, the divided portion 3*a* of the guiding lens 3 (see FIG. 2A) can further include a reflection face-side connection face 3*a*6*b* configured to connect the reflection face 3*a*5*a* with the reflection face 3*a*5*b*, a reflection face-side connection face 3*a*6*c* configured to connect the reflection face 3*a*5*b* with the reflection face 3*a*5*c*, a reflection face-side connection face 3*a*6*d* configured to connect the reflection face 3*a*5*c* with the reflection face 3*a*5*d*, a reflection face-side connection face 3*a*6*e* configured to connect the reflection face 3*a*5*d* with the reflection face 3*a*5*e*, and reflection face-side connection faces 3*a*6*a*1 and 3*a*6*a*2 configured to connect the light-exiting face 3*a*4*a* with the reflection face 3*a*5*a*.

In the vehicular lamp 100 of the first exemplary embodiment, as shown in FIG. 2C, the divided portion 3*a* of the guiding lens 3 (see FIG. 2A) can further include light-exiting face-side connection faces 3*a*7*a*1 and 3*a*7*a*2 configured to connect the light-exiting face 3*a*4*a* with the light-exiting face 3*a*4*b*, light-exiting face-side connection faces 3*a*7*b*1 and 3*a*7*b*2 configured to connect the light-exiting face 3*a*4*b* with the light-exiting face 3*a*4*c*, light-exiting face-side connection faces 3*a*7*c*1 and 3*a*7*c*2 configured to connect the light-exiting face 3*a*4*c* with the reflection face 3*a*4*d*, a light-exiting face-side connection face 3*a*7*d* configured to connect the reflection face 3*a*4*d* with the reflection face 3*a*4*e*, and a light-exiting face-side connection face 3*a*7*e* configured to connect the light-exiting face 3*a*4*e* with the light-exiting face 3*a*3.

Specifically, in the vehicular lamp 100 of the first exemplary embodiment, as shown in FIGS. 2B and 2C, the outer-diameter side end 3*a*4*a*1 of the light-exiting face 3*a*4*a* of the divided portion 3*a* can be disposed at a farthest position from the optical axis 1' of the light source 1 in the plane S3*a* containing the optical axis 1' and the maximum radius portion P3*a* of the divided portion 3*a*.

As a result, in the vehicular lamp 100 of the first exemplary embodiment as shown in FIGS. 6A to 6C, the light-exiting faces 3*a*3, 3*a*4*a*, 3*a*4*b*, 3*a*4*c*, 3*a*4*d*, and 3*a*4*e* can be seen to be bright when viewed from the front side in the optical axis direction (right upper side of FIGS. 6A to 6C). Specifically, in the vehicular lamp 100 of the first exemplary embodiment, when the divided portion 3*a* of the guiding lens 3 (see FIG. 2A) is viewed from the optical axis direction of the light source 1 (right upper side of FIGS. 6A to 6C), the cross-hatched portion as shown in FIG. 11A can be seen as if it is illuminated with light in the divided portion 3*a*.

Further, in the vehicular lamp 100 of the first exemplary embodiment, as shown in FIGS. 3A and 3B, the divided portion 3*b* adjacent to the divided portion 3*a* (see FIG. 2A) can be prepared in the following manner. Namely, a cross-sectional shape (see FIG. 3B) appearing on a plane S3*b* (see FIG. 3A) containing the optical axis 1' of the light source 1 and the maximum radius portion P3*b* (see FIG. 3A) of the divided portion 3*b* farthest from the optical axis 1' (or the center of the guiding lens 3) can be rotated around the optical axis 1' by 30 degrees to form a rotational body 3*b*' of sector shape (see FIG. 3A) as a basic block. The basic block or the rotational body 3*b*' can be cut along the sides AB and BC of the rectangle (see FIG. 2A) so that the excess portions 3*b*" over the outline of the rectangle (see FIG. 3A) is removed, thereby forming the divided portion 3*b*.

Figure 7A:
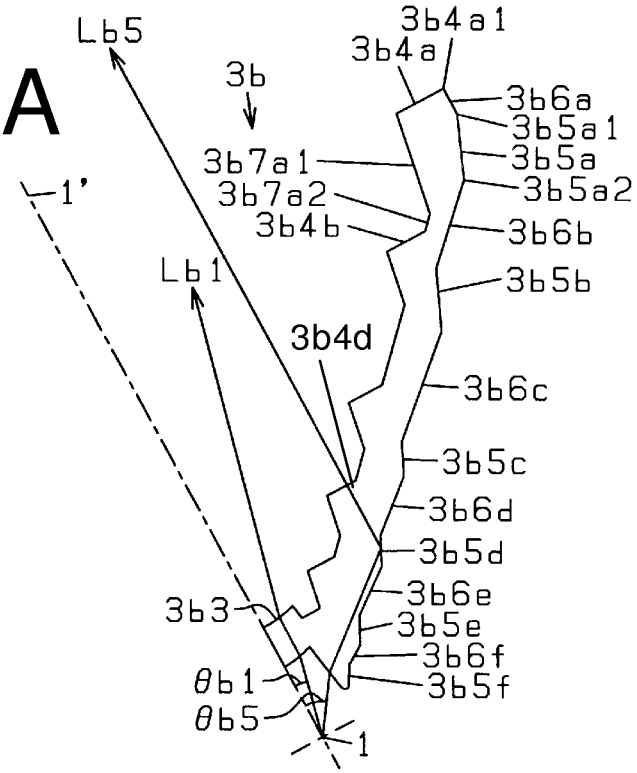
FIGS. 7A and 7B show the paths of light emitted from the light source and guided by the guiding lens part shown in the cross-section of FIG. 3B.

Furthermore, in the vehicular lamp 100 of the first exemplary embodiment, as shown in FIG. 7A, the divided portion 3*b* of the guiding lens 3 can include an incidence face 3*b*1 (see FIG. 3B) on which light emitted from the light source 1 at an angle θ*b*1 with respect to the optical axis 1' of the light source 1 is incident and a light-exiting face 3*b*3 through which the light from the incidence face 3*b*1 passes to be projected in the illumination direction of the vehicular lamp 100 (left upper side of FIG. 7A). Specifically, in the vehicular lamp 100 of the first exemplary embodiment, as shown in FIG. 7A, the light Lb1 that is emitted from the light source 1 at the angle θ*b*1 with respect to the optical axis 1' and passes through the incidence face 3*b*1 and the light-exiting face 3*b*3 of the divided portion 3*b* can be projected in the illumination direction of the vehicular lamp 100 (left upper side of FIG. 7A).

In the vehicular lamp 100 of the first exemplary embodiment, as shown in FIGS. 7A to 8B, the divided portion 3*b* of the guiding lens 3 (see FIG. 2A) can further include an incidence face 3*b*2 (see FIG. 3B) on which light emitted from the light source 1 at angles θb2, θb3, θb4, θb5, θb6, and θb7 with respect to the optical axis 1' (wherein θb1<θb2<θb3<θb4<θb5<θb6<θb7) is incident.

Figure 7B:
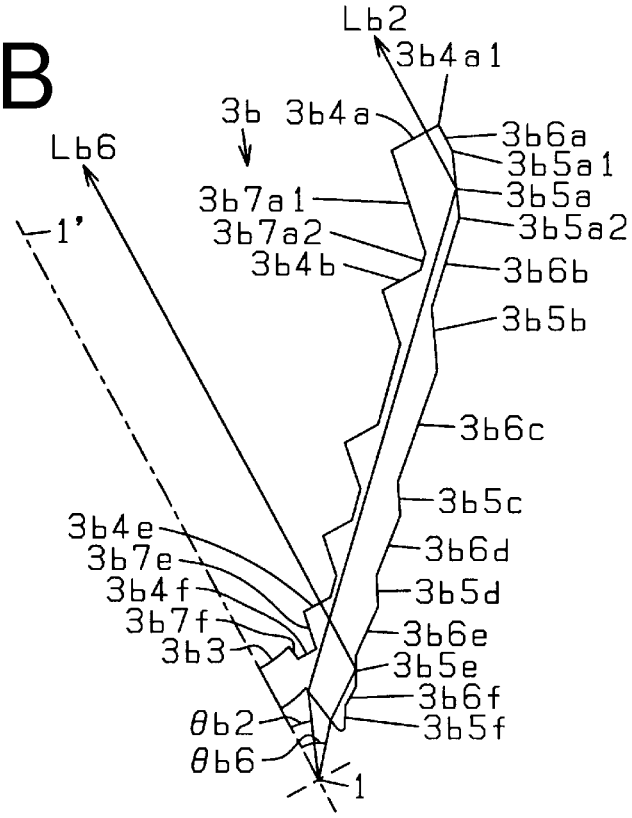

In the vehicular lamp 100 of the first exemplary embodiment, as shown in FIG. 7B, the divided portion 3*b* of the guiding lens 3 (see FIG. 2A) can further include a reflection face 3*b*5*a* configured to reflect the light emitted from the light source 1 at the angle θb2 with respect to the optical axis 1' and having passed through the incidence face 3*b*2 (see FIG. 3B), in the optical axis direction and a light-exiting face 3*b*4*a* through which the light from the reflection face 3*b*5*a* passes to be projected in the illumination direction of the vehicular lamp 100 (left upper side of FIG. 7B). Specifically, in the vehicular lamp 100 of the first exemplary embodiment, as shown in FIG. 7B, the light Lb2 that is emitted from the light source 1 at the angle θb2 with respect to the optical axis 1' and passes through the incidence face 3*b*2 of the divided portion 3*b*, is reflected by the reflection face 3*b*5*a*, and passes through the light-exiting face 3*b*4*a* can be projected as parallel light in the illumination direction of the vehicular lamp 100 (left upper side of FIG. 7B). Specifically, in the vehicular lamp 100 of the first exemplary embodiment, the light-exiting face 3*b*4*a* of the divided portion 3*b* can be configured such that almost all the light passing through the light-exiting face 3*b*4*a* can become parallel with the optical axis 1' of the light source 1.

Figure 8A:
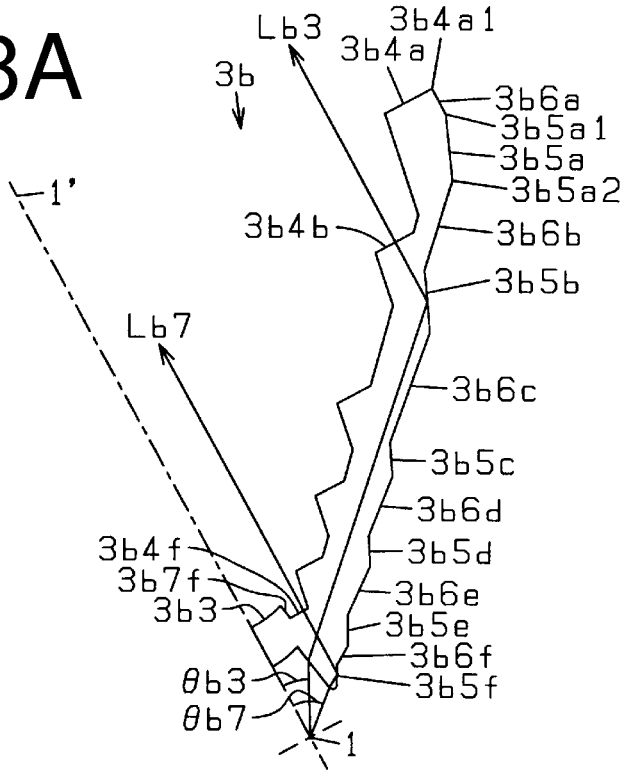
FIGS. 8A and 8B show paths of light emitted from the light source and guided by the guiding lens part shown in the cross-section of FIG. 3B.

In the vehicular lamp 100 of the first exemplary embodiment, as shown in FIG. 8A, the divided portion 3*b* of the guiding lens 3 (see FIG. 2A) can further include a reflection face 3*b*5*b* configured to reflect the light emitted from the light source 1 at the angle θb3 with respect to the optical axis 1' and having passed through the incidence face 3*b*2 (see FIG. 3B), in the optical axis direction and a light-exiting face 3*b*4*b* through which the light from the reflection face 3*b*5*b* passes to be projected in the illumination direction of the vehicular lamp 100 (left upper side of FIG. 8A). Specifically, in the vehicular lamp 100 of the first exemplary embodiment, as shown in FIG. 8A, the light Lb3 that is emitted from the light source 1 at the angle θb3 with respect to the optical axis 1' and passes through the incidence face 3*b*2 of the divided portion 3*b*, is reflected by the reflection face 3*b*5*b*, and passes through the light-exiting face 3*b*4*b* can be projected as parallel light in the illumination direction of the vehicular lamp 100 (left upper side of FIG. 8A). Specifically, in the vehicular lamp 100 of the first exemplary embodiment, the light-exiting face 3*b*4*b* of the divided portion 3*b* can be configured such that almost all the light passing through the light-exiting face 3*b*4*b* can become parallel with the optical axis 1' of the light source 1. In one modified example of the vehicular lamp 100 of the first exemplary embodiment, the light-exiting face 3*b*4*b* of the divided portion 3*b* can be configured such that part of the light passing through the light-exiting face 3*b*4*b* can become parallel with the optical axis 1' and the remaining part of the light passing through the light-exiting face 3*b*4*b* can become light travelling at a certain angle with respect to the optical axis 1'. In another modified example of the vehicular lamp 100 of the first exemplary embodiment, the light-exiting face 3*b*4*b* of the divided portion 3*b* can be configured such that all the light passing through the light-exiting face 3*b*4*b* can become light travelling at a certain angle with respect to the optical axis 1'.

Figure 8B:
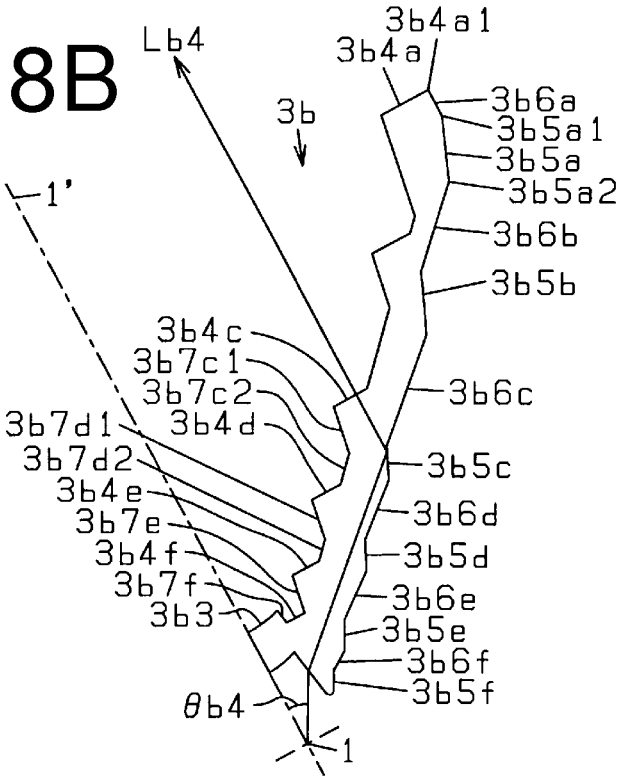

In the vehicular lamp 100 of the first exemplary embodiment, as shown in FIG. 8B, the divided portion 3*b* of the guiding lens 3 (see FIG. 2A) can further include a reflection face 3*b*5*c* configured to reflect the light emitted from the light source 1 at the angle θb4 with respect to the optical axis 1' and having passed through the incidence face 3*b*2 (see FIG. 3B), in the optical axis direction and a light-exiting face 3*b*4*c* through which the light from the reflection face 3*b*5*c* passes to be projected in the illumination direction of the vehicular lamp 100 (left upper side of FIG. 8B). Specifically, in the vehicular lamp 100 of the first exemplary embodiment, as shown in FIG. 8B, the light Lb4 that is emitted from the light source 1 at the angle θb4 with respect to the optical axis 1' and passes through the incidence face 3*b*2 of the divided portion 3*b*, is reflected by the reflection face 3*b*5*c*, and passes through the light-exiting face 3*b*4*c* can be projected as parallel light in the illumination direction of the vehicular lamp 100 (left upper side of FIG. 8B). Specifically, in the vehicular lamp 100 of the first exemplary embodiment, the light-exiting face 3*b*4*c* of the divided portion 3*b* can be configured such that almost all the light passing through the light-exiting face 3*b*4*c* can become parallel with the optical axis 1' of the light source 1. In one modified example of the vehicular lamp 100 of the first exemplary embodiment, the light-exiting face 3*b*4*c* of the divided portion 3*b* can be configured such that part of the light passing through the light-exiting face 3*b*4*c* can become parallel with the optical axis 1' and the remaining part of the light passing through the light-exiting face 3*b*4*c* can become light travelling at a certain angle with respect to the optical axis 1'. In another modified example of the vehicular lamp 100 of the first exemplary embodiment, the light-exiting face 3*b*4*c* of the divided portion 3*b* can be configured such that all the light passing through the light-exiting face 3*b*4*c* can become light travelling at a certain angle with respect to the optical axis 1'.

In the vehicular lamp 100 of the first exemplary embodiment, as shown in FIG. 7A, the divided portion 3*b* of the guiding lens 3 (see FIG. 2A) can further include a reflection face 3*b*5*d* configured to reflect the light emitted from the light source 1 at the angle θb5 with respect to the optical axis 1' and passing through the incidence face 3*b*2 (see FIG. 3B), in the optical axis direction and a light-exiting face 3*b*4*d* through which the light from the reflection face 3*b*5*d* passes to be projected in the illumination direction of the vehicular lamp 100 (left upper side of FIG. 7A). Specifically, in the vehicular lamp 100 of the first exemplary embodiment, as shown in FIG. 7A, the light Lb5 that is emitted from the light source 1 at the angle θb5 with respect to the optical axis 1' and passes through the incidence face 3*b*2 of the divided portion 3*b*, is reflected by the reflection face 3*b*5*d*, and passes through the light-exiting face 3*b*4*d* can be projected as parallel light in the illumination direction of the vehicular lamp 100 (left upper side of FIG. 7A). Specifically, in the vehicular lamp 100 of the first exemplary embodiment, the light-exiting face 3*b*4*d* of the divided portion 3*b* can be configured such that almost all the light passing through the light-exiting face 3*b*4*d* can become parallel with the optical axis 1' of the light source 1. In one modified example of the vehicular lamp 100 of the first exemplary embodiment, the light-exiting face 3*b*4*d* of the divided portion 3*b* can be configured such that part of the light passing through the light-exiting face 3*b*4*d* can become parallel with the optical axis 1' and the remaining part of the light having passed through the light-exiting face 3*b*4*d* can become light travelling at a certain angle with respect to the optical axis 1'. In another modified example of the vehicular lamp 100 of the first exemplary embodiment, the light-exiting face 3*b*4*d* of the divided portion 3*b* can be configured such that all the light passing through the light-exiting face 3*b*4*d* can become light travelling at a certain angle with respect to the optical axis 1'.

In the vehicular lamp 100 of the first exemplary embodiment, as shown in FIG. 7B, the divided portion 3*b* of the guiding lens 3 (see FIG. 2A) can further include a reflection face 3*b*5*e* configured to reflect the light emitted from the light source 1 at an angle θb6 with respect to the optical axis 1' and having passed through the incidence face 3*b*2 (see FIG. 3B), in the optical axis direction and a light-exiting face 3*b*4*e* through which the light from the reflection face 3*b*5*e* passes to be projected in the illumination direction of the vehicular lamp 100 (left upper side of FIG. 7B). Specifically, in the vehicular lamp 100 of the first exemplary embodiment, as shown in FIG. 7B, the light Lb6 that is emitted from the light source 1 at the angle θb6 with respect to the optical axis 1' and passes through the incidence face 3*b*2 of the divided portion 3*b*, is reflected by the reflection face 3*b*5*e*, and passes through the light-exiting face 3*b*4*e* can be projected as parallel light in the illumination direction of the vehicular lamp 100 (left upper side of FIG. 7B). Specifically, in the vehicular lamp 100 of the first exemplary embodiment, the light-exiting face 3*b*4*e* of the divided portion 3*b* can be configured such that almost all the light passing through the light-exiting face 3*b*4*e* can become parallel with the optical axis 1' of the light source 1. In one modified example of the vehicular lamp 100 of the first exemplary embodiment, the light-exiting face 3*b*4*e* of the divided portion 3*b* can be configured such that part of the light passing through the light-exiting face 3*b*4*e* can become parallel with the optical axis 1' and the remaining part of the light passing through the light-exiting face 3*b*4*e* can become light travelling at a certain angle with respect to the optical axis 1'. In another modified example of the vehicular lamp 100 of the first exemplary embodiment, the light-exiting face 3*b*4*e* of the divided portion 3*b* can be configured such that all the light passing through the light-exiting face 3*b*4*e* can become light travelling at a certain angle with respect to the optical axis 1'.

In the vehicular lamp 100 of the first exemplary embodiment, as shown in FIG. 8B, the divided portion 3*b* of the guiding lens 3 (see FIG. 2A) can further include a reflection face 3*b*5*f* configured to reflect the light emitted from the light source 1 at an angle θb7 with respect to the optical axis 1' and passing through the incidence face 3*b*2 (see FIG. 3B), in the optical axis direction and a light-exiting face 3*b*4*f* through which the light from the reflection face 3*b*5*f* passes to be projected in the illumination direction of the vehicular lamp 100 (left upper side of FIG. 8A). Specifically, in the vehicular lamp 100 of the first exemplary embodiment, as shown in FIG. 8A, the light Lb7 that is emitted from the light source 1 at the angle θb7 with respect to the optical axis 1' and passes through the incidence face 3*b*2 of the divided portion 3*b*, is reflected by the reflection face 3*b*5*f*, and passes through the light-exiting face 3*b*4*f* can be projected as parallel light in the illumination direction of the vehicular lamp 100 (left upper side of FIG. 8A). Specifically, in the vehicular lamp 100 of the first exemplary embodiment, the light-exiting face 3*b*4*f* of the divided portion 3*b* can be configured such that almost all the light passing through the light-exiting face 3*b*4*f* can become parallel with the optical axis 1' of the light source 1. In one modified example of the vehicular lamp 100 of the first exemplary embodiment, the light-exiting face 3*b*4*f* of the divided portion 3*b* can be configured such that part of the light passing through the light-exiting face 3*b*4*f* can become parallel with the optical axis 1' and the remaining part of the light passing through the light-exiting face 3*b*4*f* can become light travelling at a certain angle with respect to the optical axis 1'. In another modified example of the vehicular lamp 100 of the first exemplary embodiment, the light-exiting face 3*b*4*f* of the divided portion 3*b* can be configured such that all the light passing through the light-exiting face 3*b*4*f* can become light travelling at a certain angle with respect to the optical axis 1'.

In the vehicular lamp 100 of the first exemplary embodiment, as shown in FIG. 3B, the divided portion 3*b* of the guiding lens 3 (see FIG. 2A) can further include a reflection face-side connection face 3*b*6*b* configured to connect the reflection face 3*b*5*a* with the reflection face 3*b*5*b*, a reflection face-side connection face 3*b*6*c* configured to connect the reflection face 3*b*5*b* with the reflection face 3*b*5*c*, a reflection face-side connection face 3*b*6*d* configured to connect the reflection face 3*b*5*c* with the reflection face 3*b*5*d*, a reflection face-side connection face 3*b*6*e* configured to connect the reflection face 3*b*5*d* with the reflection face 3*b*5*e*, and a reflection face-side connection face 3*b*6*a* configured to connect the light-exiting face 3*b*4*a* with the reflection face 3*b*5*a*.

In the vehicular lamp 100 of the first exemplary embodiment, as shown in FIG. 3B, the divided portion 3*b* of the guiding lens 3 (see FIG. 2A) can further include light-exiting face-side connection faces 3*b*7*a*1 and 3*b*7*a*2 configured to connect the light-exiting face 3*b*4*a* with the light-exiting face 3*b*4*b*, light-exiting face-side connection faces 3*b*7*b*1 and 3*b*7*b*2 configured to connect the light-exiting face 3*b*4*b* with the light-exiting face 3*b*4*c*, light-exiting face-side connection faces 3*b*7*c*1 and 3*b*7*c*2 configured to connect the light-exiting face 3*b*4*c* with the reflection face 3*b*4*d*, light-exiting face-side connection faces 3*b*7*d*1 and 3*b*7*d*2 configured to connect the reflection face 3*b*4*d* with the reflection face 3*b*4*e*, a light-exiting face-side connection face 3*b*7*e* configured to connect the light-exiting face 3*b*4*e* with the light-exiting face 3*b*4*f*, and a light-exiting face-side connection face 3*b*7*f* configured to connect the light-exiting face 3*b*4*f* with the light-exiting face 3*b*3.

Specifically, in the vehicular lamp 100 of the first exemplary embodiment, as shown in FIGS. 3A and 3B, the outer-diameter side end 3*b*4*a*1 of the light-exiting face 3*b*4*a* of the divided portion 3*b* can be disposed at a farthest position from the optical axis 1' of the light source 1 in the plane S3*b* containing the optical axis 1' and the maximum radius portion P3*b* of the divided portion 3*b*.

As a result, in the vehicular lamp 100 of the first exemplary embodiment as shown in FIGS. 7A to 8B, the light-exiting faces 3*b*3, 3*b*4*a*, 3*b*4*b*, 3*b*4*c*, 3*b*4*d*, 3*b*4*e*, and 3*b*4*f* can be seen to be bright when viewed from the front side in the optical axis direction (left upper side of FIGS. 7A to 8B). Specifically, in the vehicular lamp 100 of the first exemplary embodiment, when the divided portion 3*b* of the guiding lens 3 (see FIG.

2A) is viewed from the optical axis direction of the light source 1 (left upper side of FIGS. 7A to 8B), the cross-hatched portion as shown in FIG. 11A can be seen as if it is illuminated with light in the divided portion 3*b*.

Further, in the vehicular lamp 100 of the first exemplary embodiment, as shown in FIGS. 4A and 4B, the divided portion 3*c* adjacent to the divided portion 3*b* (see FIG. 2A) can be prepared in the following manner. Namely, a cross-sectional shape (see FIG. 4B) appearing on a plane S3*c* (see FIG. 4A) containing the optical axis 1' of the light source 1 and the maximum radius portion P3*c* (see FIG. 4A) of the divided portion 3*c* farthest from the optical axis 1' (or the center of the guiding lens 3) can be rotated around the optical axis 1' by 30 degrees to form a rotational body 3*c*' of sector shape (see FIG. 4A) as a basic block. The basic block or the rotational body 3*c*' can be cut along the side BC of the rectangle (see FIG. 2A) so that the excess portion 3*c*" over the outline of the rectangle (see FIG. 4A) is removed, thereby forming the divided portion 3*c*.

Furthermore, in the vehicular lamp 100 of the first exemplary embodiment, as shown in FIG. 9A, the divided portion 3*c* of the guiding lens 3 can include an incidence face 3*c*1 (see FIG. 4B) on which light emitted from the light source 1 at an angle θc1 with respect to the optical axis 1' of the light source 1 is incident and a light-exiting face 3*c*3 through which the light from the incidence face 3*c*1 passes to be projected in the illumination direction of the vehicular lamp 100 (left upper side of FIG. 9A). Specifically, in the vehicular lamp 100 of the first exemplary embodiment, as shown in FIG. 9A, the light Lc1 that is emitted from the light source 1 at the angle θc1 with respect to the optical axis 1' and passes through the incidence face 3*c*1 and the light-exiting face 3*c*3 of the divided portion 3*c* can be projected in the illumination direction of the vehicular lamp 100 (left upper side of FIG. 9A).

In the vehicular lamp 100 of the first exemplary embodiment, as shown in FIGS. 9A to 9C, the divided portion 3*c* of the guiding lens 3 (see FIG. 2A) can further include an incidence face 3*c*2 (see FIG. 4B) on which light emitted from the light source 1 at angles θc2, θc3, θc4, and θc5 with respect to the optical axis 1' (wherein θc1<θc2<θc3<θc4<θc5).

In the vehicular lamp 100 of the first exemplary embodiment, as shown in FIG. 9B, the divided portion 3*c* of the guiding lens 3 (see FIG. 2A) can further include a reflection face 3*c*5*a* configured to reflect the light emitted from the light source 1 at the angle θc2 with respect to the optical axis 1' and having passed through the incidence face 3*c*2 (see FIG. 4B), in the optical axis direction and a light-exiting face 3*c*4*a* through which the light from the reflection face 3*c*5*a* passes to be projected in the illumination direction of the vehicular lamp 100 (left upper side of FIG. 9B). Specifically, in the vehicular lamp 100 of the first exemplary embodiment, as shown in FIG. 9B, the light Lc2 that is emitted from the light source 1 at the angle θc2 with respect to the optical axis 1' and passes through the incidence face 3*c*2 of the divided portion 3*c*, is reflected by the reflection face 3*c*5*a*, and passes through the light-exiting face 3*c*4*a* can be projected as parallel light in the illumination direction of the vehicular lamp 100 (left upper side of FIG. 9B). Specifically, in the vehicular lamp 100 of the first exemplary embodiment, the light-exiting face 3*c*4*a* of the divided portion 3*c* can be configured such that almost all the light passing through the light-exiting face 3*c*4*a* can become parallel with the optical axis 1' of the light source 1.

In the vehicular lamp 100 of the first exemplary embodiment, as shown in FIG. 9C, the divided portion 3*c* of the guiding lens 3 (see FIG. 2A) can further include a reflection face 3*c*5*b* configured to reflect the light emitted from the light source 1 at the angle θc3 with respect to the optical axis 1' and having passed through the incidence face 3*c*2 (see FIG. 4B), in the optical axis direction and a light-exiting face 3*c*4*b* through which the light from the reflection face 3*c*5*b* passes to be projected in the illumination direction of the vehicular lamp 100 (left upper side of FIG. 9C). Specifically, in the vehicular lamp 100 of the first exemplary embodiment, as shown in FIG. 9C, the light Lc3 that is emitted from the light source 1 at the angle θc3 with respect to the optical axis 1' and passes through the incidence face 3*c*2 of the divided portion 3*c*, is reflected by the reflection face 3*c*5*b*, and passes through the light-exiting face 3*c*4*b* can be projected as parallel light in the illumination direction of the vehicular lamp 100 (left upper side of FIG. 9C). Specifically, in the vehicular lamp 100 of the first exemplary embodiment, the light-exiting face 3*c*4*b* of the divided portion 3*c* can be configured such that almost all the light passing through the light-exiting face 3*c*4*b* can become parallel with the optical axis 1' of the light source 1. In one modified example of the vehicular lamp 100 of the first exemplary embodiment, the light-exiting face 3*c*4*b* of the divided portion 3*c* can be configured such that part of the light passing through the light-exiting face 3*c*4*b* can become parallel with the optical axis 1' and the remaining part of the light passing through the light-exiting face 3*c*4*b* can become light travelling at a certain angle with respect to the optical axis 1'. In another modified example of the vehicular lamp 100 of the first exemplary embodiment, the light-exiting face 3*c*4*b* of the divided portion 3*c* can be configured such that all the light passing through the light-exiting face 3*c*4*b* can become light travelling at a certain angle with respect to the optical axis 1'.

In the vehicular lamp 100 of the first exemplary embodiment, as shown in FIG. 9A, the divided portion 3*c* of the guiding lens 3 (see FIG. 2A) can further include a reflection face 3*c*5*c* configured to reflect the light emitted from the light source 1 at the angle θc4 with respect to the optical axis 1' and having passed through the incidence face 3*c*2 (see FIG. 4B), in the optical axis direction and a light-exiting face 3*c*4*c* through which the light from the reflection face 3*c*5*c* passes to be projected in the illumination direction of the vehicular lamp 100 (left upper side of FIG. 9A). Specifically, in the vehicular lamp 100 of the first exemplary embodiment, as shown in FIG. 9A, the light Lc4 that is emitted from the light source 1 at the angle θc4 with respect to the optical axis 1' and passes through the incidence face 3*c*2 of the divided portion 3*c*, is reflected by the reflection face 3*c*5*c*, and passes through the light-exiting face 3*c*4*c* can be projected as parallel light in the illumination direction of the vehicular lamp 100 (left upper side of FIG. 9A). Specifically, in the vehicular lamp 100 of the first exemplary embodiment, the light-exiting face 3*c*4*c* of the divided portion 3*c* can be configured such that almost all the light passing through the light-exiting face 3*c*4*c* can become parallel with the optical axis 1' of the light source 1. In one modified example of the vehicular lamp 100 of the first exemplary embodiment, the light-exiting face 3*c*4*c* of the divided portion 3*c* can be configured such that part of the light passing through the light-exiting face 3*c*4*c* can become parallel with the optical axis 1' and the remaining part of the light passing through the light-exiting face 3*c*4*c* can become light travelling at a certain angle with respect to the optical axis 1'. In another modified example of the vehicular lamp 100 of the first exemplary embodiment, the light-exiting face 3*c*4*c* of the divided portion 3*c* can be configured such that all the light passing through the light-exiting face 3*c*4*c* can become light travelling at a certain angle with respect to the optical axis 1'.

In the vehicular lamp 100 of the first exemplary embodiment, as shown in FIG. 9B, the divided portion 3*c* of the guiding lens 3 (see FIG. 2A) can further include a reflection face 3*c*5*d* configured to reflect the light emitted from the light source 1 at the angle θc5 with respect to the optical axis 1' and having passed through the incidence face 3*c*2 (see FIG. 4B), in the optical axis direction and a light-exiting face 3*c*4*d* through which the light from the reflection face 3*c*5*d* passes to be projected in the illumination direction of the vehicular lamp 100 (left upper side of FIG. 9B). Specifically, in the vehicular lamp 100 of the first exemplary embodiment, as shown in FIG. 9B, the light Lc5 that is emitted from the light source 1 at the angle θc5 with respect to the optical axis 1' and passes through the incidence face 3*c*2 of the divided portion 3*c*, is reflected by the reflection face 3*c*5*d*, and passes through the light-exiting face 3*c*4*d* can be projected as parallel light in the illumination direction of the vehicular lamp 100 (left upper side of FIG. 9B). Specifically, in the vehicular lamp 100 of the first exemplary embodiment, the light-exiting face 3*c*4*d* of the divided portion 3*c* can be configured such that almost all the light passing through the light-exiting face 3*c*4*d* can become parallel with the optical axis 1' of the light source 1. In one modified example of the vehicular lamp 100 of the first exemplary embodiment, the light-exiting face 3*c*4*d* of the divided portion 3*c* can be configured such that part of the light passing through the light-exiting face 3*c*4*d* can become parallel with the optical axis 1' and the remaining part of the light passing through the light-exiting face 3*c*4*d* can become light travelling at a certain angle with respect to the optical axis 1'. In another modified example of the vehicular lamp 100 of the first exemplary embodiment, the light-exiting face 3*c*4*d* of the divided portion 3*c* can be configured such that all the light passing through the light-exiting face 3*c*4*d* can become light travelling at a certain angle with respect to the optical axis 1'.

In the vehicular lamp 100 of the first exemplary embodiment, as shown in FIG. 4B, the divided portion 3*c* of the guiding lens 3 (see FIG. 2A) can further include a reflection face-side connection face 3*c*6*b* configured to connect the reflection face 3*c*5*a* with the reflection face 3*c*5*b*, a reflection face-side connection face 3*c*6*c* configured to connect the reflection face 3*c*5*b* with the reflection face 3*c*5*c*, and a reflection face-side connection face 3*c*6*d* configured to connect the reflection face 3*c*5*c* with the reflection face 3*c*5*d*.

In the vehicular lamp 100 of the first exemplary embodiment, as shown in FIG. 4B, the divided portion 3*c* of the guiding lens 3 (see FIG. 2A) can further include a light-exiting face-side connection face 3*c*7*a* configured to connect the light-exiting face 3*c*4*a* with the light-exiting face 3*c*4*b*, light-exiting face-side connection faces 3*c*7*b* 1 and 3*c*7*b*2 configured to connect the light-exiting face 3*c*4*b* with the light-exiting face 3*c*4*c*, a light-exiting face-side connection face 3*c*7*c* configured to connect the light-exiting face 3*c*4*c* with the reflection face 3*c*4*d*, and a light-exiting face-side connection faces 3*c*7*d* configured to connect the reflection face 3*c*4*d* with the reflection face 3*c*3.

Specifically, in the vehicular lamp 100 of the first exemplary embodiment, as shown in FIGS. 4A and 4B, the outer-diameter side end 3*c*4*a*1 of the light-exiting face 3*c*4*a* of the divided portion 3*c* can be disposed at a farthest position from the optical axis 1' of the light source 1 in the plane S3*c* containing the optical axis 1' and the maximum radius portion P3*c* of the divided portion 3*c*.

As a result, in the vehicular lamp 100 of the first exemplary embodiment as shown in FIGS. 9A to 9C, the light-exiting faces 3*c*3, 3*c*4*a*, 3*c*4*b*, 3*c*4*c*, and 3*c*4*d* can be seen to be bright when viewed from the front side in the optical axis direction (left upper side of FIGS. 9A to 9C). Specifically, in the vehicular lamp 100 of the first exemplary embodiment, when the divided portion 3*c* of the guiding lens 3 (see FIG. 2A) is viewed from the optical axis direction of the light source 1 (left upper side of FIGS. 9A to 9C), the cross-hatched portion as shown in FIG. 11A can be seen as if it is illuminated with light in the divided portion 3*c*.

Further, in the vehicular lamp 100 of the first exemplary embodiment, as shown in FIGS. 5A and 5B, the divided portion 3*d* adjacent to the divided portion 3*c* (see FIG. 2A) can be prepared in the following manner. Namely, a cross-sectional shape (see FIG. 5B) appearing on a plane S3*d* (see FIG. 5A) containing the optical axis 1' of the light source 1 and the maximum radius portion P3*d* (see FIG. 5A) of the divided portion 3*d* farthest from the optical axis 1' (or the center of the guiding lens 3) can be rotated around the optical axis 1' by 30 degrees to form a rotational body 3*d'* of sector shape (see FIG. 5A) as a basic block. The basic block or the rotational body 3*d'* can be cut along the side BC of the rectangle (see FIG. 2A) so that the excess portion 3*d"* over the outline of the rectangle (see FIG. 5A) is removed, thereby forming the divided portion 3*d*.

Furthermore, in the vehicular lamp 100 of the first exemplary embodiment, as shown in FIG. 10A, the divided portion 3*d* of the guiding lens 3 can include an incidence face 3*d*1 (see FIG. 5B) on which light emitted from the light source 1 at an angle θd1 with respect to the optical axis 1' of the light source 1 is incident and a light-exiting face 3*d*3 through which the light from the incidence face 3*d*1 passes to be projected in the illumination direction of the vehicular lamp 100 (left upper side of FIG. 10A). Specifically, in the vehicular lamp 100 of the first exemplary embodiment, as shown in FIG. 10A, the light Ld1 that is emitted from the light source 1 at the angle θd1 with respect to the optical axis 1' and passes through the incidence face 3*d*1 and the light-exiting face 3*d*3 of the divided portion 3*d* can be projected in the illumination direction of the vehicular lamp 100 (left upper side of FIG. 10A).

In the vehicular lamp 100 of the first exemplary embodiment, as shown in FIGS. 10A to 10C, the divided portion 3*d* of the guiding lens 3 (see FIG. 2A) can further include an incidence face 3*d*2 (see FIG. 5B) on which light emitted from the light source 1 at angles θd2, θd3, θd4, and θd5 with respect to the optical axis 1' (wherein θd1<θd2<θd3<θd4<θd5).

In the vehicular lamp 100 of the first exemplary embodiment, as shown in FIG. 10B, the divided portion 3*d* of the guiding lens 3 (see FIG. 2A) can further include a reflection face 3*d*5*a* configured to reflect the light emitted from the light source 1 at the angle θd2 with respect to the optical axis 1' and having passed through the incidence face 3*d*2 (see FIG. 5B), in the optical axis direction and a light-exiting face 3*d*4*a* through which the light from the reflection face 3*d*5*a* passes to be projected in the illumination direction of the vehicular lamp 100 (left upper side of FIG. 10B). Specifically, in the vehicular lamp 100 of the first exemplary embodiment, as shown in FIG. 10B, the light Ld2 that is emitted from the light source 1 at the angle θd2 with respect to the optical axis 1' and passes through the incidence face 3*d*2 of the divided portion 3*d*, is reflected by the reflection face 3*d*5*a*, and passes through the light-exiting face 3*d*4*a* can be projected as parallel light in the illumination direction of the vehicular lamp 100 (left upper side of FIG. 10B). Specifically, in the vehicular lamp 100 of the first exemplary embodiment, the light-exiting face 3*d*4*a* of the divided portion 3*d* can be configured such that almost all the light passing through the light-exiting face 3*d*4*a* can become parallel with the optical axis 1' of the light source 1.

In the vehicular lamp 100 of the first exemplary embodiment, as shown in FIG. 10C, the divided portion 3*d* of the guiding lens 3 (see FIG. 2A) can further include a reflection face 3*d*5*b* configured to reflect the light emitted from the light source 1 at the angle θd3 with respect to the optical axis 1' and having passed through the incidence face 3*d*2 (see FIG. 5B), in the optical axis direction and a light-exiting face 3*d*4*b* through which the light from the reflection face 3*d*5*b* passes to be projected in the illumination direction of the vehicular lamp 100 (left upper side of FIG. 10C). Specifically, in the vehicular lamp 100 of the first exemplary embodiment, as shown in FIG. 10C, the light Ld3 that is emitted from the light source 1 at the angle θd3 with respect to the optical axis 1' and passes through the incidence face 3*d*2 of the divided portion 3*d*, is reflected by the reflection face 3*d*5*b*, and passes through the light-exiting face 3*d*4*b* can be projected as parallel light in the illumination direction of the vehicular lamp 100 (left upper side of FIG. 10C). Specifically, in the vehicular lamp 100 of the first exemplary embodiment, the light-exiting face 3*d*4*b* of the divided portion 3*d* can be configured such that almost all the light passing through the light-exiting face 3*d*4*b* can become parallel with the optical axis 1' of the light source 1. In one modified example of the vehicular lamp 100 of the first exemplary embodiment, the light-exiting face 3*d*4*b* of the divided portion 3*d* can be configured such that part of the light passing through the light-exiting face 3*d*4*b* can become parallel with the optical axis 1' and the remaining part of the light passing through the light-exiting face 3*d*4*b* can become light travelling at a certain angle with respect to the optical axis 1'. In another modified example of the vehicular lamp 100 of the first exemplary embodiment, the light-exiting face 3*d*4*b* of the divided portion 3*c* can be configured such that all the light passing through the light-exiting face 3*d*4*b* can become light travelling at a certain angle with respect to the optical axis 1'.

In the vehicular lamp 100 of the first exemplary embodiment, as shown in FIG. 10A, the divided portion 3*d* of the guiding lens 3 (see FIG. 2A) can further include a reflection face 3*d*5*c* configured to reflect the light emitted from the light source 1 at the angle θd4 with respect to the optical axis 1' and having passed through the incidence face 3*d*2 (see FIG. 5B), in the optical axis direction and a light-exiting face 3*d*4*c* through which the light from the reflection face 3*d*5*c* passes to be projected in the illumination direction of the vehicular lamp 100 (left upper side of FIG. 10A). Specifically, in the vehicular lamp 100 of the first exemplary embodiment, as shown in FIG. 10A, the light Ld4 that is emitted from the light source 1 at the angle θd4 with respect to the optical axis 1' and passes through the incidence face 3*d*2 of the divided portion 3*d*, is reflected by the reflection face 3*d*5*c*, and passes through the light-exiting face 3*d*4*c* can be projected as parallel light in the illumination direction of the vehicular lamp 100 (left upper side of FIG. 10A). Specifically, in the vehicular lamp 100 of the first exemplary embodiment, the light-exiting face 3*d*4*c* of the divided portion 3*d* can be configured such that almost all the light passing through the light-exiting face 3*d*4*c* can become parallel with the optical axis 1' of the light source 1. In one modified example of the vehicular lamp 100 of the first exemplary embodiment, the light-exiting face 3*d*4*c* of the divided portion 3*d* can be configured such that part of the light passing through the light-exiting face 3*d*4*c* can become parallel with the optical axis 1' and the remaining part of the passing through the light-exiting face 3*d*4*c* can become light travelling at a certain angle with respect to the optical axis 1'. In another modified example of the vehicular lamp 100 of the first exemplary embodiment, the light-exiting face 3*d*4*c* of the divided portion 3*d* can be configured such that all the light passing through the light-exiting face 3*d*4*c* can become light travelling at a certain angle with respect to the optical axis 1'.

In the vehicular lamp 100 of the first exemplary embodiment, as shown in FIG. 10B, the divided portion 3*d* of the guiding lens 3 (see FIG. 2A) can further include a reflection face 3*d*5*d* configured to reflect the light emitted from the light source 1 at the angle θd5 with respect to the optical axis 1' and having passed through the incidence face 3*d*2 (see FIG. 5B), in the optical axis direction and a light-exiting face 3*d*4*d* through which the light from the reflection face 3*d*5*d* passes to be projected in the illumination direction of the vehicular lamp 100 (left upper side of FIG. 10B). Specifically, in the vehicular lamp 100 of the first exemplary embodiment, as shown in FIG. 10B, the light Ld5 that is emitted from the light source 1 at the angle θd5 with respect to the optical axis 1' and passes through the incidence face 3*d*2 of the divided portion 3*d*, is reflected by the reflection face 3*d*5*d*, and passes through the light-exiting face 3*d*4*d* can be projected as parallel light in the illumination direction of the vehicular lamp 100 (left upper side of FIG. 10B). Specifically, in the vehicular lamp 100 of the first exemplary embodiment, the light-exiting face 3*d*4*d* of the divided portion 3*d* can be configured such that almost all the light passing through the light-exiting face 3*d*4*d* can become parallel with the optical axis 1' of the light source 1. In one modified example of the vehicular lamp 100 of the first exemplary embodiment, the light-exiting face 3*d*4*d* of the divided portion 3*d* can be configured such that part of the light passing through the light-exiting face 3*d*4*d* can become parallel with the optical axis 1' and the remaining part of the light passing through the light-exiting face 3*d*4*d* can become light travelling at a certain angle with respect to the optical axis 1'. In another modified example of the vehicular lamp 100 of the first exemplary embodiment, the light-exiting face 3*d*4*d* of the divided portion 3*d* can be configured such that all the light passing through the light-exiting face 3*d*4*d* can become light travelling at a certain angle with respect to the optical axis 1'.

In the vehicular lamp 100 of the first exemplary embodiment, as shown in FIG. 5B, the divided portion 3*d* of the guiding lens 3 (see FIG. 2A) can further include a reflection face-side connection face 3*d*6*b* configured to connect the reflection face 3*d*5*a* with the reflection face 3*d*5*b*, a reflection face-side connection face 3*d*6*c* configured to connect the reflection face 3*d*5*b* with the reflection face 3*d*5*c*, a reflection face-side connection face 3*d*6*d* configured to connect the reflection face 3*d*5*c* with the reflection face 3*d*5*d*, and a reflection face-side connection face 3*d*6*a* configured to connect the light-exiting face 3*d*4*a* with the reflection face 3*d*5*a*.

In the vehicular lamp 100 of the first exemplary embodiment, as shown in FIG. 5B, the divided portion 3*d* of the guiding lens 3 (see FIG. 2A) can further include a light-exiting face-side connection face 3*d*7*a* configured to connect the light-exiting face 3*d*4*a* with the light-exiting face 3*d*4*b*, a light-exiting face-side connection face 3*d*7*b* configured to connect the light-exiting face 3*d*4*b* with the light-exiting face 3*d*4*c*, and a light-exiting face-side connection face 3*d*7*c* configured to connect the light-exiting face 3*d*4*c* with the reflection face 3*d*4*d*.

Specifically, in the vehicular lamp 100 of the first exemplary embodiment, as shown in FIGS. 5A and 5B, the outer-diameter side end 3*d*4*a*1 of the light-exiting face 3*d*4*a* of the divided portion 3*d* can be disposed at a farthest position from the optical axis 1' of the light source 1 in the plane S3*d* containing the optical axis 1' and the maximum radius portion P3*d* of the divided portion 3*d*.

As a result, in the vehicular lamp 100 of the first exemplary embodiment as shown in FIGS. 10A to 10C, the light-exiting faces 3*d*3, 3*d*4*a*, 3*d*4*b*, 3*d*4*c*, and 3*d*4*d* can be seen to be bright when viewed from the front side in the optical axis direction (left upper side of FIGS. 10A to 10C). Specifically, in the vehicular lamp 100 of the first exemplary embodiment, when the divided portion 3*d* of the guiding lens 3 (see FIG. 2A) is viewed from the optical axis direction of the light source 1 (left upper side of FIGS. 10A to 10C), the cross-hatched portion as shown in FIG. 11A can be seen as if it is illuminated with light in the divided portion 3*d*.

In the vehicular lamp 100 of the first exemplary embodiment, as shown in FIG. 2A, the divided portion 3*e* adjacent to the divided portion 3*d* can be configured to be symmetric with the divided portion 3*c* about a vertical plane VS. Accordingly, in the vehicular lamp 100 of the first exemplary embodiment, when the divided portion 3*e* of the guiding lens 3 is viewed from the optical axis direction of the light source 1 (lower side in FIG. 1B and left side in FIG. 1C), the cross-hatched portion as shown in FIG. 11A can be seen as if it is illuminated with light in the divided portion 3*e*.

In the vehicular lamp 100 of the first exemplary embodiment, as shown in FIG. 2A, the divided portion 3*f* adjacent to the divided portion 3*e* and can be configured to be symmetric with the divided portion 3*b* about the vertical plane VS. Accordingly, in the vehicular lamp 100 of the first exemplary embodiment, when the divided portion 3*f* of the guiding lens 3 is viewed from the optical axis direction of the light source 1 (lower side in FIG. 1B and left side in FIG. 1C), the cross-hatched portion as shown in FIG. 11A can be seen as if it is illuminated with light in the divided portion 3*e*.

In the vehicular lamp 100 of the first exemplary embodiment, as shown in FIG. 2A, the divided portion 3*g* adjacent to the divided portion 3*f* can be configured to be symmetric with the divided portion 3*a* about the vertical plane VS. Accordingly, in the vehicular lamp 100 of the first exemplary embodiment, when the divided portion 3*g* of the guiding lens 3 is viewed from the optical axis direction of the light source 1 (lower side in FIG. 1B and left side in FIG. 1C), the cross-hatched portion as shown in FIG. 11A can be seen as if it is illuminated with light in the divided portion 3*g*.

In the vehicular lamp 100 of the first exemplary embodiment, as shown in FIG. 2A, the divided portion 3*h* adjacent to the divided portion 3*g* can be configured to be symmetric with the divided portion 3*f* about a horizontal plane HS. Accordingly, in the vehicular lamp 100 of the first exemplary embodiment, when the divided portion 3*h* of the guiding lens 3 is viewed from the optical axis direction of the light source 1 (lower side in FIG. 1B and left side in FIG. 1C), the cross-hatched portion as shown in FIG. 11A can be seen as if it is illuminated with light in the divided portion 3*h*.

In the vehicular lamp 100 of the first exemplary embodiment, as shown in FIG. 2A, the divided portion 3*i* adjacent to the divided portion 3*h* can be configured to be symmetric with the divided portion 3*e* about the horizontal plane HS. Accordingly, in the vehicular lamp 100 of the first exemplary embodiment, when the divided portion 3*i* of the guiding lens 3 is viewed from the optical axis direction of the light source 1 (lower side in FIG. 1B and left side in FIG. 1C), the cross-hatched portion as shown in FIG. 11A can be seen as if it is illuminated with light in the divided portion 3*i*.

In the vehicular lamp 100 of the first exemplary embodiment, as shown in FIG. 2A, the divided portion 3*j* adjacent to the divided portion 3*i* can be configured to be symmetric with the divided portion 3*d* about the horizontal plane HS. Accordingly, in the vehicular lamp 100 of the first exemplary embodiment, when the divided portion 3*j* of the guiding lens 3 is viewed from the optical axis direction of the light source 1 (lower side in FIG. 1B and left side in FIG. 1C), the cross-hatched portion as shown in FIG. 11A can be seen as if it is illuminated with light in the divided portion 3*j*.

In the vehicular lamp 100 of the first exemplary embodiment, as shown in FIG. 2A, the divided portion 3*k* adjacent to the divided portion 3*j* can be configured to be symmetric with the divided portion 3*c* about the horizontal plane HS. Accordingly, in the vehicular lamp 100 of the first exemplary embodiment, when the divided portion 3*k* of the guiding lens 3 is viewed from the optical axis direction of the light source 1 (lower side in FIG. 1B and left side in FIG. 1C), the cross-hatched portion as shown in FIG. 11A can be seen as if it is illuminated with light in the divided portion 3*k*.

In the vehicular lamp 100 of the first exemplary embodiment, as shown in FIG. 2A, the divided portion 3*m* adjacent to the divided portion 3*k* can be configured to be symmetric with the divided portion 3*b* about the horizontal plane HS. Accordingly, in the vehicular lamp 100 of the first exemplary embodiment, when the divided portion 3*m* of the guiding lens 3 is viewed from the optical axis direction of the light source 1 (lower side in FIG. 1B and left side in FIG. 1C), the cross-hatched portion as shown in FIG. 11A can be seen as if it is illuminated with light in the divided portion 3*m*.

Further, as shown in FIG. 11B as a comparative example, a comparative guiding lens 903 can be prepared in the following manner. Namely, a cross-sectional shape (similar to the cross section viewpoint of FIG. 2C) appearing on the plane S903*b* containing the optical axis of the light source (see, for example, optical axis 1' and light source 1 of FIG. 2A) can be rotated around the optical axis by 360 degrees to form a rotational body as a basic block. The basic block or the rotational body is cut along the outline of the rectangle (specifically, the sides AB, BC, CD, and DA of the rectangle) so that the excess portions over the outline of the rectangle (see, for example, FIG. 5A) are removed, thereby forming the comparative guiding lens 903. In this case, when the comparative guiding lens 903 is viewed from the optical axis direction of the light source, only the cross-hatched portion as shown in FIG. 11B can be seen as if it is illuminated with light.

Accordingly, when compared with the case where the guiding lens 903 is composed of a rotational body obtained by rotating a cross-sectional shape appearing on the plane S903*b* containing the optical axis of the light source around the optical axis by 360 degrees, and cutting the body along a desired polygonal outline, the light-exiting faces 3*a*4*a*, 3*b*4*a*, 3*c*4*a*, and 3*d*4*a* (see FIGS. 2B, 3A, 4A, and 5A) can be disposed on the sides AB, BC, CD, and DA of the rectangle at a higher possibility.

In other words, the vehicular lamp 100 according to the first exemplary embodiment can improve the ratio of the rectangle sides AB, BC, CD, and DA that can be seen to be bright when viewed from the side in the optical axis direction (see FIG. 1A and FIG. 11A) when compared with the conventional vehicular lamp with the above configuration as shown in FIG. 11B. Namely, the guiding lens 3 of the vehicular lamp 100 according to the first exemplary embodiment can show a clear polygonal outline (specifically, the rectangle sides AB, BC, CD, and DA) when viewed from the side in the optical axis direction when compared with the conventional vehicular lamp with the above configuration in FIG. 11B. Further, in the conventional vehicular lamp shown in FIG. 11B, when the light is emitted substantially radially in the optical axis direction of the light source to be guided to the light-exiting face-side connection faces (such as those analogous to faces 3*b*7*a*1, 3*b*7*a*2, 3*b*7*b*1, and 3*b*7*b*2 of FIGS. 3A and 3B) on the sides BC and DA of the rectangle by the guiding lens 903, the light may not be projected in the illumination direction of the vehicular lamp 100, but may be leaked upward and downward (in FIG. 11B). As a result, the conventional vehicular lamp of FIG. 11B may deteriorate the use efficiency of light emitted from the light source.

In contrast, the vehicular lamp 100 according to the first exemplary embodiment can provide the light-exiting faces 3*b*4*a* and 3*b*4*b* of the divided portion 3*b*, the light-exiting face 3*c*4*a* of the divided block 3*c*, and the light-exiting face 3*b*4*b* of the divided portion 3*d* on the side BC of the rectangle, for example, as shown in FIGS. 3A, 4A, and 5A. Accordingly, the vehicular lamp 100 according to the first exemplary embodiment can reduce the ratio of light that cannot be projected in the illumination direction of the vehicular lamp 100 out of the light emitted from the light source 1 and impinging on the guiding lens 3. Specifically, the vehicular lamp 100 according to the first exemplary embodiment as shown in FIG. 11A can enhance the use efficiency of light emitted from the light source 1 when compared with the conventional vehicular lamp with the above configuration in FIG. 11B.

Figure 12A:
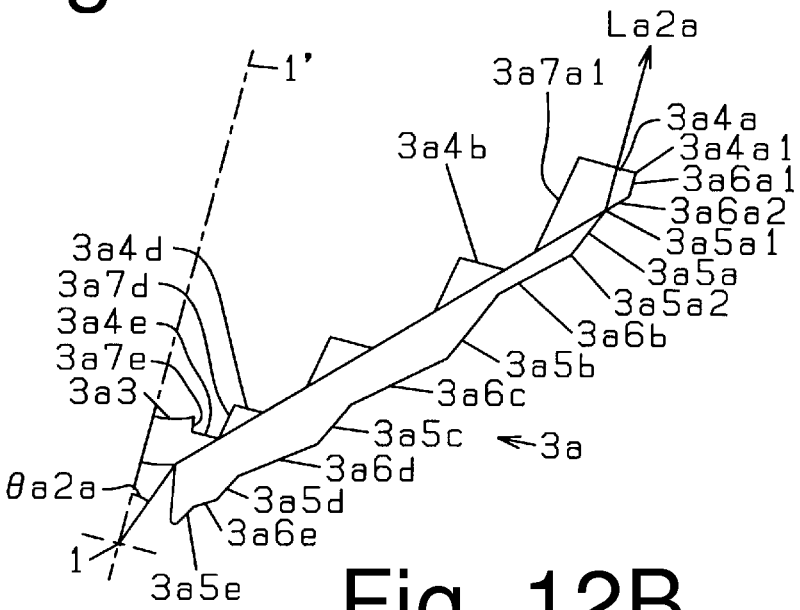
FIGS. 12A and 12B are cross-sectional views of the part of the guiding lens in FIG. 2C, each showing, in particular, reflection surfaces of that divided portion of the guiding lens.
Figure 12B:
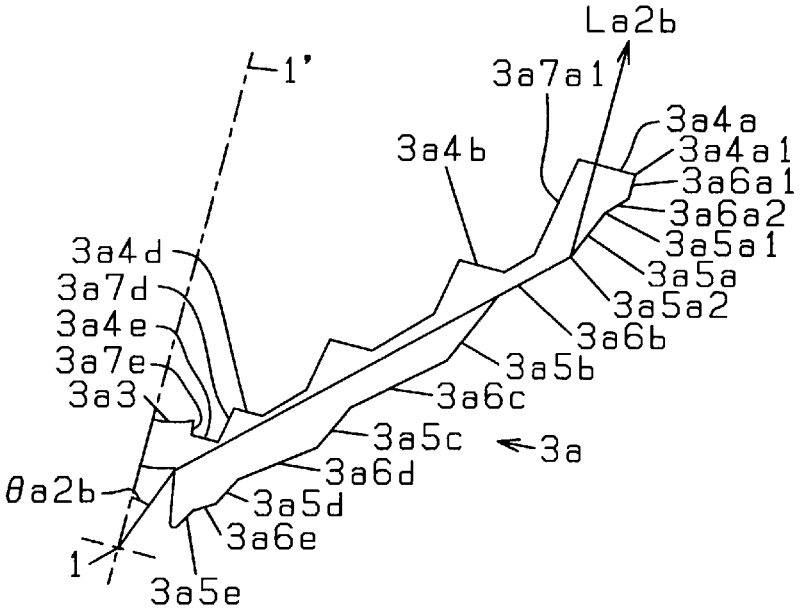
Figure 13A:
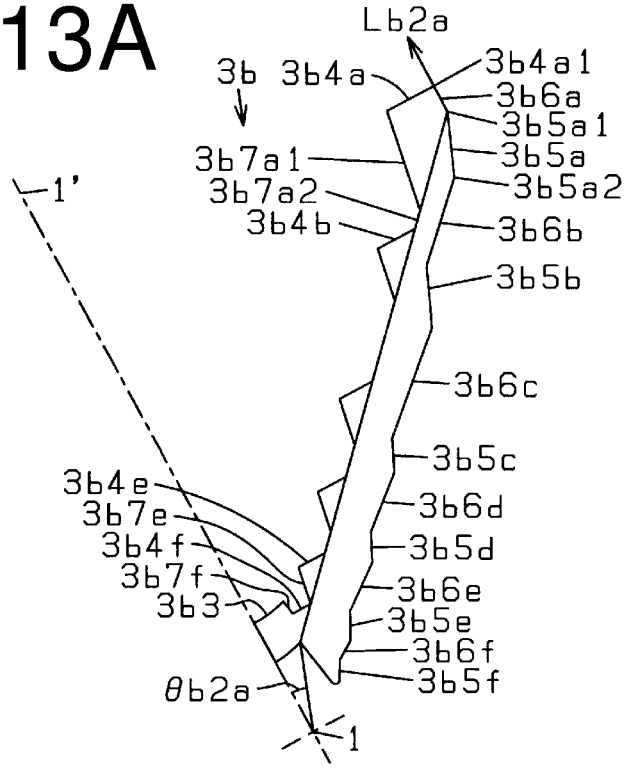
FIGS. 13A and 13B are cross-sectional views of the part of the guiding lens in FIG. 3B, each showing, in particular, reflection surfaces of that divided portion of the guiding lens.
Figure 13B:
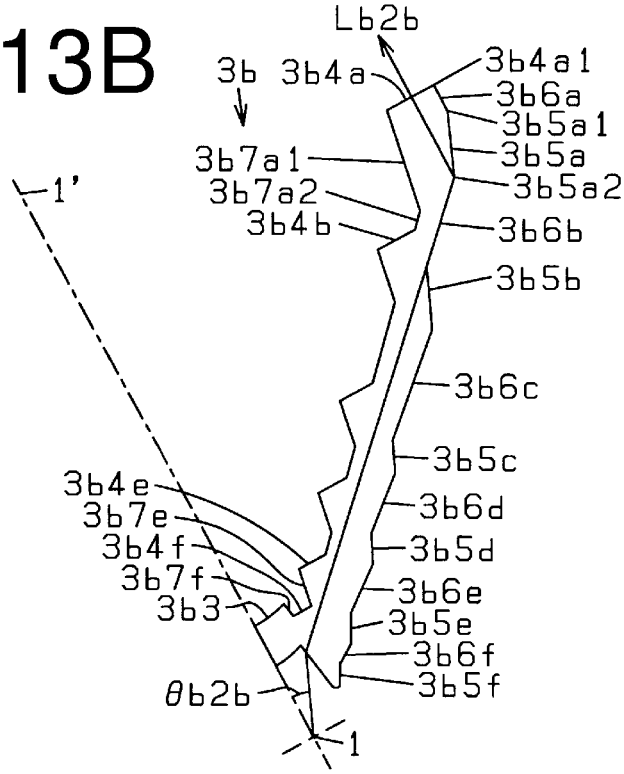

FIGS. 12A and 12B are cross-sectional views of the part of the guiding lens 3 of the vehicular lamp 100 according to the first exemplary embodiment as shown in FIG. 2C, each showing reflection faces 3*a*5*a* of the divided portion 3*a* of the guiding lens 3 in detail. FIGS. 13A and 13B are cross-sectional views of the part of the guiding lens 3 in FIG. 3B each showing reflection faces 3*b*5*a* of the divided portion 3*b* of the guiding lens 3.

In the vehicular lamp 100 according to the first exemplary embodiment, as shown in FIGS. 2B and 3A, suppose a case where a first sector is obtained by rotating a segment connecting the maximum radius portion P3*a* of the divided portion 3*a* to the optical axis 1' (the segment being perpendicular to the optical axis 1') by 30 degrees around the optical axis 1' as a center. Further, suppose that a second sector is obtained by rotating a segment connecting the maximum radius portion P3*b* of the divided portion 3*b* adjacent to the divided portion 3*a* to the optical axis 1' (the segment being perpendicular to the optical axis 1') by 30 degrees around the optical axis 1' as a center. In this case, the difference area 3*a*" between the first sector and a projected area of the divided portion 3*a* of the guiding lens 3 when viewed from the front side in the optical axis direction (or excess portion 3*a*" over the side AB of the rectangle) may be smaller than the difference area 3*b*" between the second sector and a projected area of the divided portion 3*b* of the guiding lens 3 when viewed from the front side in the optical axis direction (or excess portion 3*b*" over the sides AB and BC of the rectangle).

In view of this, as shown in FIGS. 12A to 13B, the reflection face 3*a*5*a* of the divided portion 3*a* and the reflection face 3*b*5*a* of the divided portion 3*b* the vehicular lamp 100 according to the first exemplary embodiment can be configured such that a difference between a first angle θa2*a* and a second angle θa2*b* is smaller than a difference between a third angle θb2*a* and a fourth angle θb2*b* wherein: the first angle θa2*a* is formed between the optical axis 1' of the light source 1 and the light La2*a* incident on an outer-diameter side end 3*a*5*a*1 of the reflection face 3*a*5*a* of the divided portion 3*a* within the plane S3*a* containing the maximum radius portion P3*a* of the divided portion 3*a* and the optical axis 1' of the light source 1 (or within the cross-section shown in FIGS. 2C, 12A and 12B); the second angle θa2*b* is formed between the optical axis 1' of the light source 1 and the light La2*b* incident on an inner-diameter side end 3*a*5*a*2 of the reflection face 3*a*5*a* of the divided portion 3*a* within the plane S3*a* containing the maximum radius portion P3*a* of the divided portion 3*a* and the optical axis 1' of the light source 1 (see FIG. 12A); the third angle θb2*a* is formed between the optical axis 1' of the light source 1 and the light Lb2*a* incident on an outer-diameter side end 3*b*5*a*1 of the reflection face 3*b*5*a* of the divided portion 3*b* within a plane S3*b* containing the maximum radius portion P3*b* of the divided portion 3*b* and the optical axis 1' of the light source 1 (or within the cross-section shown in FIGS. 3B, 13A, and 13B), and the fourth angle θb2*b* is formed between the optical axis 1' of the light source 1 and the light Lb2*b* incident on an inner-diameter side end 3*b*5*a*2 of the reflection face 3*b*5*a* of the divided portion 3*b* within the plane containing the maximum radius portion P3*b* of the divided portion 3*b* and the optical axis 1' of the light source 1 (see FIG. 13B).

In other words, the vehicular lamp 100 according to the first exemplary embodiment can be configured such that the area of the excess portion 3*a*" (see FIG. 2B) is smaller than the area of the excess portion 3*b*" (see FIG. 3A). Accordingly, the amount of light that is emitted from the light source 1 and enters the reflection face 3*a*5*a* of the divided portion 3*a* within the cross-section shown in FIGS. 12A and 12B can be made smaller than that of the light that is emitted from the light source 1 and enters the reflection face 3*b*5*a* of the divided portion 3*b* within the cross-section shown in FIGS. 13A and 13B.

When the reflection face 3*a*5*a* of the divided portion 3*a* and the reflection face 3*b*5*a* of the divided portion 3*b* are configured such that the difference between the first and second angles (θa2*b*-θa2*a*) is equal to the difference between the third and fourth angles (θb2*b*-θb2*a*), the light that passes through the light-exiting face 3*b*4*a* of the divided portion 3*b* and is reflected by the reflection face 3*b*5*a* of the divided portion 3*b* in the illuminating direction of the vehicular lamp 100 may be seen darker than the light that passes through the light-exiting face 3*a*4*a* of the divided portion 3*a* and is reflected by the reflection face 3*a*5*a* of the divided portion 3*a* in the illuminating direction of the vehicular lamp 100. However, the vehicular lamp 100 with the above configuration can avoid such a phenomenon.

Namely, when compared with the case where the reflection face 3*a*5*a* of the divided portion 3*a* and the reflection face 3*b*5*a* of the divided portion 3*b* are configured such that the difference between the first and second angles (θa2*b*-θa2*a*) is equal to the difference between the third and fourth angles (θb2*b*-θb2*a*), the respective sides AB, BC, CD, and DA of the rectangle when the guiding lens 3 is viewed from the optical axis 1' direction of the light source 1 can be observed to be illuminated with a uniform brightness.

Figure 14A:
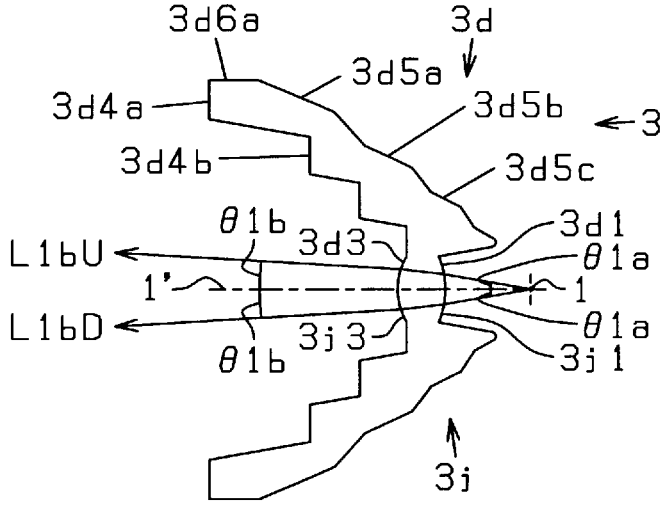
FIG. 14A is a vertical cross-sectional view of the guiding lens according to the first embodiment showing the paths of light projected through light-exiting faces in the illumination direction.
Figure 14B:
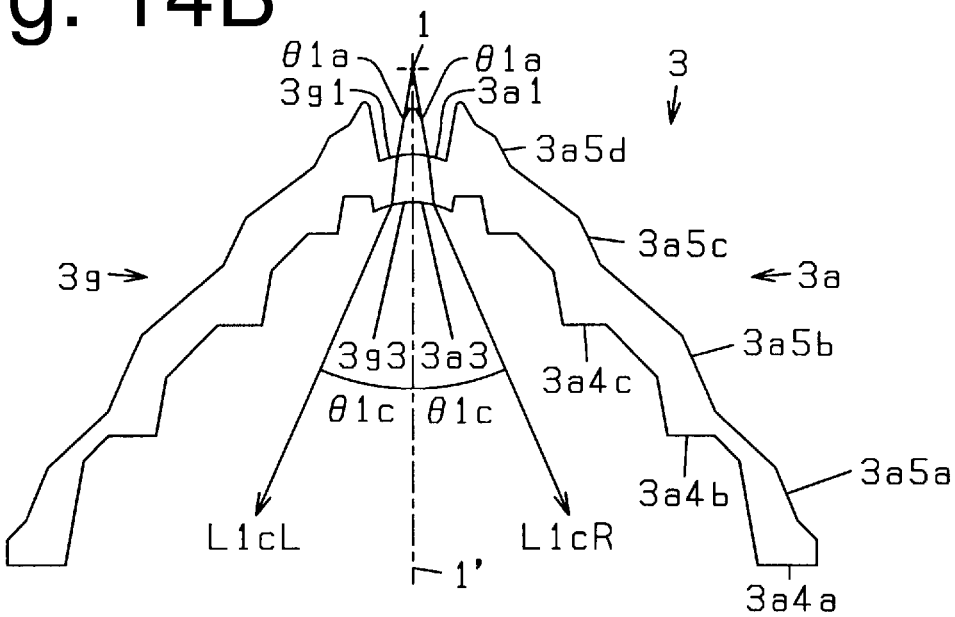
FIG. 14B is a horizontal cross-sectional view of the guiding lens according to the first embodiment showing the paths of light projected through light-exiting faces in the illumination direction.
Figure 15:
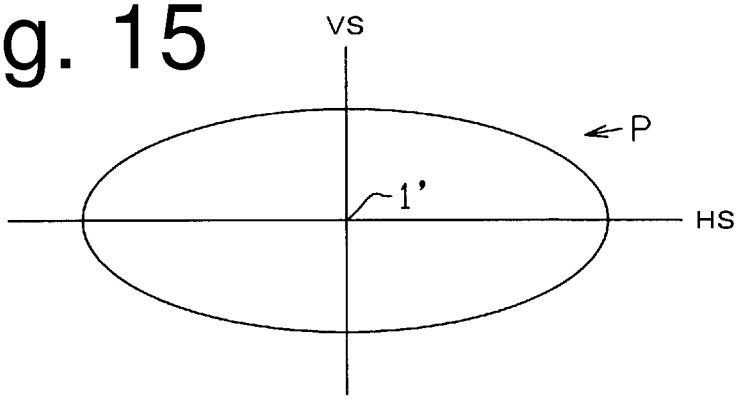
FIG. 15 shows a light distribution pattern formed by light having passed through light-exiting faces of the upper, lower, left and right side divided portions of the guiding lens according to the first embodiment.

FIG. 14A is a vertical cross-sectional view (including the vertical plane VS) of the guiding lens 3 of the vehicular lamp 100 according to the first exemplary embodiment, showing the paths of light L1*b*U and L1*b*D projected through the respective light-exiting faces 3*d*3 and 3*j*3 of the divided portions 3*d* and 3*j* in the illumination direction. FIG. 14B is a horizontal cross-sectional view (including the horizontal plane HS) of the guiding lens 3 of the vehicular lamp 100 according to the first exemplary embodiment, showing the paths of light L1*c*R and L1*c*L projected through the respective light-exiting faces 3*a*3 and 3*g*3 of the divided portions 3*a* and 3*g* in the illumination direction. FIG. 15 shows a light distribution pattern P formed by light L1*b*U, L1*b*D, L1*c*R, and L1*c*L and the like having passed through light-exiting faces 3*a*3, 3*d*3, 3*g*3, and 3*j*3 of the upper, lower, left and right side divided portions 3*a*, 3*d*, 3*g*, and 3*j* of the guiding lens 3 of the vehicular lamp 100 according to the first exemplary embodiment.

In the vehicular lamp 100 according to the first exemplary embodiment with the above configuration, the incidence faces 3*a*1, 3*b*1, 3*c*1, and 3*d*1 of the respective divided portions 3*a*, 3*b*, 3*c*, 3*d*, 3*e*, 3*f*, 3*g*, 3*h*, 3*i*, 3*j*, 3*k*, and 3*m* can be each formed from a rotational plane obtained by rotating a curve centered on the optical axis 1' of the light source 1 by 360 degrees (see FIGS. 2C, 3B, 4B, 5B, 14A, and 14B).

Furthermore, in the vehicular lamp 100 according to the first exemplary embodiment, the light-exiting faces 3*a*3, 3*b*3, 3c3, 3d3, 3g3, and 3j3 of the respective divided portions 3a, 3b, 3c, 3d, 3e, 3f, 3g, 3h, 3i, 3j, 3k, and 3m can be configured as follows (see FIGS. 2C, 3B, 4B, 5B, 14A, and 14B). Namely with this configuration, as shown in FIG. 14A, the light emitted upward from the light source 1 at the angle θ1a (wherein 0<θ1a) with respect to the optical axis 1' can pass through the incidence face 3d1 and the light-exiting face 3d3 of the divided portion 3d that is located at a position including the vertical plane VS containing the optical axis 1' of the light source 1, so that the exiting light becomes upward light L1bU at the angle θ1b (wherein 0<θ1b<θ1a) with respect to the optical axis 1'. Further, the light emitted downward from the light source 1 at the angle θ1a with respect to the optical axis 1' of the light source 1 can pass through the incidence face 3j 1 and the light-exiting face 3j3 of the divided portion 3j that is located at a position including the vertical plane VS containing the optical axis 1', so that the exiting light becomes downward light L1bD at the angle θ1b with respect to the optical axis 1'. Still further, as shown in FIG. 14B, the light emitted rightward from the light source 1 at the angle θ1a with respect to the optical axis 1' of the light source 1 can pass through the incidence face 3a1 and the light-exiting face 3a3 of the divided portion 3a that is located at a position including the horizontal plane HS containing the optical axis 1', so that the exiting light becomes rightward light L1cR at the angle θ1c (wherein θ1b<θ1c) with respect to the optical axis 1'. Still further, the light emitted leftward from the light source 1 at the angle θ1a can pass through the incidence face 3g1 and the light-exiting face 3g3 of the divided portion 3g that is located at a position including the horizontal plane HS containing the optical axis 1', so that the exiting light becomes leftward light L1cL at the angle θ1c with respect to the optical axis 1'.

In other words, the vehicular lamp 100 according to the first exemplary embodiment can provide the light-exiting faces 3a3, 3b3, 3c3, 3d3, 3g3, and 3j3 of the respective divided portions 3a, 3b, 3c, 3d, 3e, 3f, 3g, 3h, 3i, 3j, 3k, and 3m that are not formed from a rotational plane around the optical axis 1' (see FIGS. 2C, 3B, 4B, 5B, 14A, and 14B).

Accordingly, in the above vehicular lamp 100 according to the first exemplary embodiment, the light L1bU, L1bD, L1cR, and L1cL projected from the respective divided portions 3a, 3b, 3c, 3d, 3e, 3f, 3g, 3h, 3i, 3j, 3k, and 3m of the guiding lens 3 through the respective light-exiting faces 3a3, 3b3, 3c3, 3d3, 3g3, and 3j3 in the illumination direction of the vehicular lamp 100 can form a light distribution pattern P horizontally long (see FIG. 15).

Figure 16:
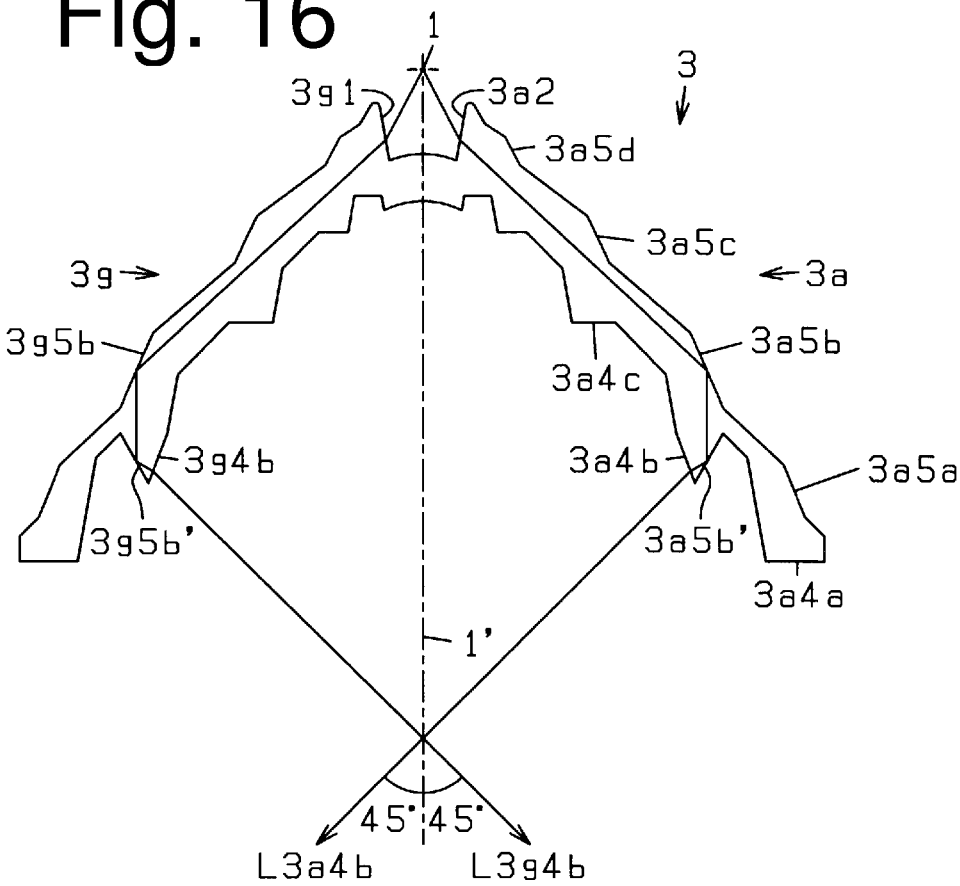
FIG. 16 is a horizontal cross-sectional view of the guiding lens according to a variation of the first embodiment showing the paths of light projected through left and right light-exiting faces in the illumination direction.
Figure 17:
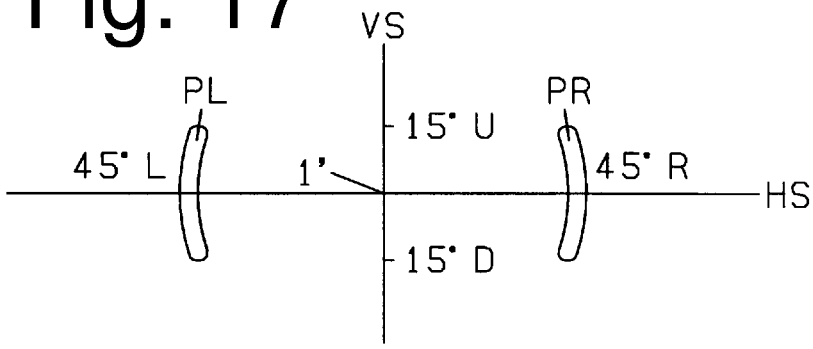
FIG. 17 shows a light distribution pattern formed by light having passed through light-exiting faces of the left and right side divided portions of the guiding lens as a variation of the present exemplary embodiment.

FIG. 16 is a horizontal cross-sectional view (including the horizontal plane HS) of the guiding lens 3 of the vehicular lamp 100 according to the first exemplary embodiment, showing the paths of light L3a4b and L3g4b projected through the respective light-exiting faces 3a4b and 3g4b of the divided portions 3a and 3g in the illumination direction. FIG. 17 shows light distribution patterns PR and PL formed by respective light L3a4b and L3g4b having passed through the respective light-exiting faces 3a4b and 3g4b of the divided portions 3a and 3g of the guiding lens 3 as a variation of the present exemplary embodiment.

In the vehicular lamp 100 according to the first exemplary embodiment with the above configuration as a variation shown in FIG. 16, the divided portions 3a and 3g that are located at the position including the horizontal plane HS containing the optical axis 1' can include respective reflection faces 3a5b' and 3g5b' configured to reflect the light traveling from the respective reflection faces 3a5b and 3g5b in the optical axis direction to guide the light at a certain angle with respect to the optical axis 1'.

In addition, in the variation of the vehicular lamp 100 according to the first exemplary embodiment, at least part of the light from the reflection faces 3a5b' and 3g5b' of the divided portions 3a and 3g that are located at respective positions within the horizontal plane HS containing the optical axis 1' can be allowed to pass through the light-exiting faces 3a4b and 3g4b, so that the light becomes rightward or leftward light L3a4b or L3g4b traveling within the horizontal plane HS at 45 degrees with respect to the optical axis 1' as shown in FIG. 16. Accordingly, when the variation of the vehicular lamp 100 is observed at a position that is on the extension of 45-degree line with respect to the optical axis 1', the light-exiting faces 3a4b and 3g4b of the divided portions 3a and 3g located at the respective positions within the horizontal plane HS containing the optical axis 1' can be observed as if they are illuminated brighter.

Figure 18:
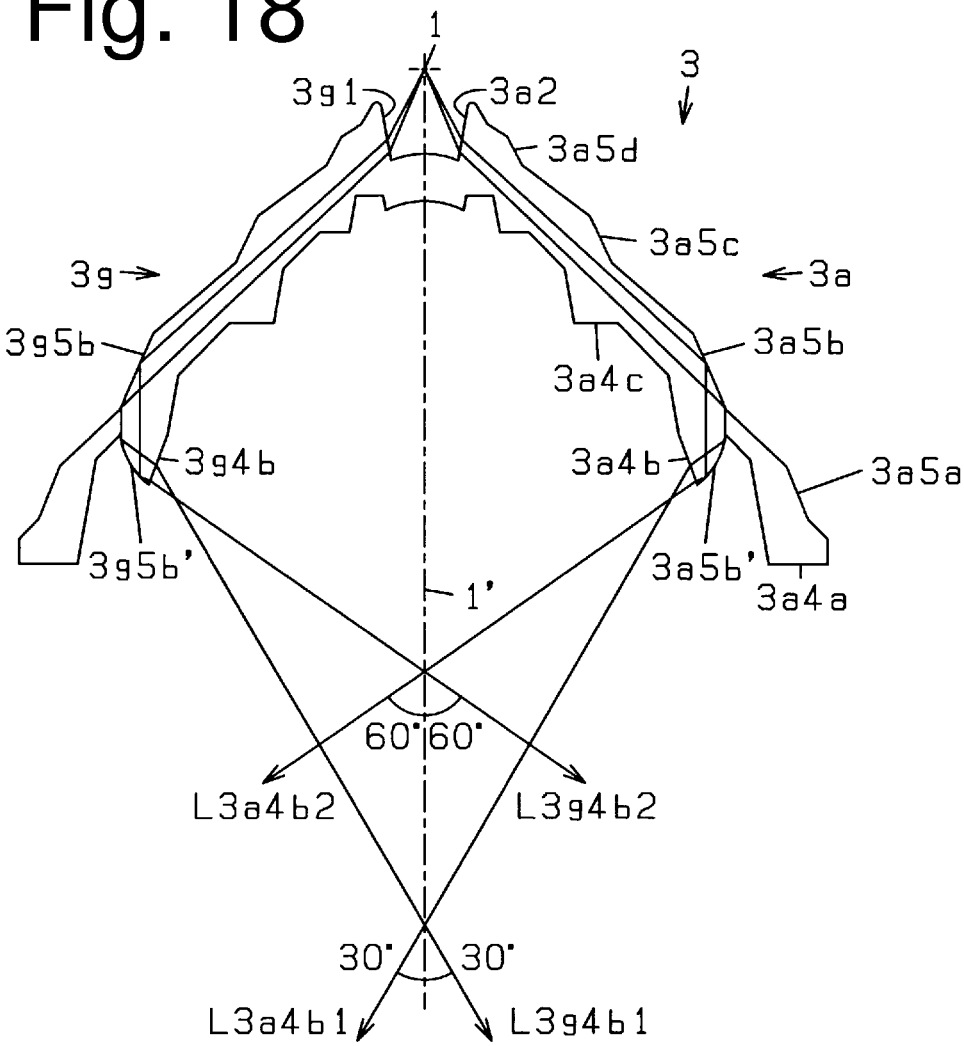
FIG. 18 is a horizontal cross-sectional view of the guiding lens showing the paths of light projected through left and right light-exiting faces in the illumination direction as another variation of the present exemplary embodiment.
Figure 19:
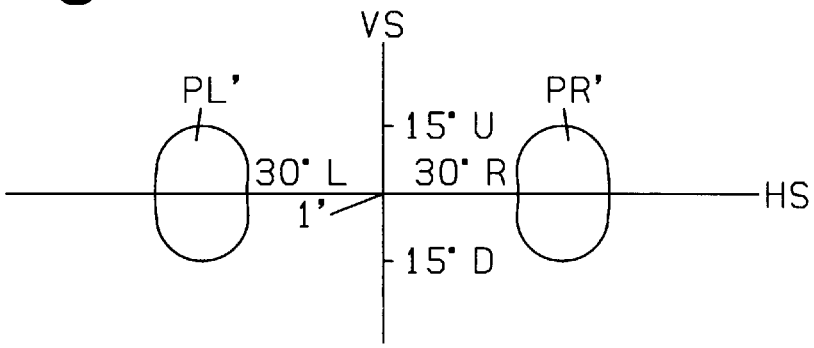
FIG. 19 shows a light distribution pattern formed by light having passed through light-exiting faces of the left and right side divided portions of the guiding lens as another variation of the present exemplary embodiment.

FIG. 18 is a horizontal cross-sectional view (including the horizontal plane HS) of the guiding lens 3 of the vehicular lamp 100 according to the first exemplary embodiment as another variation, showing the paths of light L3a4b1 and L3a4b2, and L3g4b1 and L3g4b2 projected through the respective light-exiting faces 3a4b and 3g4b of the divided portions 3a and 3g in the illumination direction. FIG. 19 shows light distribution patterns PR' and PL' formed by respective light L3a4b1 and L3a4b2, and L3g4b1 and L3g4b2 having passed through the respective light-exiting faces 3a4b and 3g4b of the divided portions 3a and 3g of the guiding lens 3 of FIG. 18.

While the previous variation of the vehicular lamp 100 is configured such that the reflection faces 3a5b' and 3g5b' of the divided portions 3a and 3g can be formed so as to have a linear cross-section within the horizontal plane HS as shown in FIG. 16, the another variation of the vehicular lamp 100 is configured such that the reflection faces 3a5b' and 3g5b' of the divided portions 3a and 3g can be formed so as to have a curved cross-section within the horizontal plane HS as shown in FIG. 18.

Accordingly, in the another variation of the vehicular lamp 100 of FIG. 18, part of the light from the reflection faces 3a5b' and 3g5b' of the divided portions 3a and 3g that are located at respective positions within the horizontal plane HS containing the optical axis 1' can be allowed to pass through the light-exiting faces 3a4b and 3g4b, so that the light becomes rightward or leftward light L3a4b1 or L3g4b1 traveling within the horizontal plane HS at 30 degrees with respect to the optical axis 1' as shown in FIG. 18. Another part of the light from the reflection faces 3a5b' and 3g5b' of the divided portions 3a and 3g can be allowed to pass through the light-exiting faces 3a4b and 3g4b, so that the light becomes rightward or leftward light L3a4b2 or L3g4b2 traveling within the horizontal plane HS at 60 degrees with respect to the optical axis 1' as shown in FIG. 18. As a result, when the another variation of the vehicular lamp 100 of the first exemplary embodiment is observed at a position that is varied within the angular range of 30 degrees to 60 degrees with respect to the optical axis 1', the light-exiting faces 3a4b and 3g4b of the divided portions 3a and 3g located at the respective positions within the horizontal plane HS containing the optical axis 1' can be observed as if they are illuminated brighter.

Figure 20:
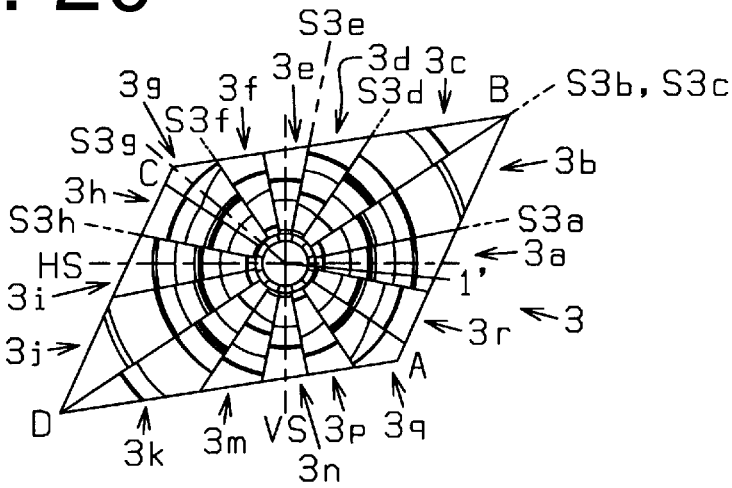
FIG. 20 is a front view showing the guiding lens of a vehicular lamp according to a second exemplary embodiment.

FIG. 20 is a front view showing the guiding lens 3 of a vehicular lamp 100 according to a second exemplary embodiment. The vehicular lamp 100 according to the first exemplary embodiment has the guiding lens 3 with the rectangular outline when viewed from the optical axis direction of the light source 1 as shown in FIG. 2A. Instead, the vehicular lamp 100 according to the second exemplary embodiment has the guiding lens 3 with the parallelogram outline when viewed from the optical axis direction of the light source 1 as shown in FIG. 20.

Furthermore, in the vehicular lamp 100 according to the second exemplary embodiment, the guiding lens 3 can be configured to include a plurality of divided portions or 16 divided portions 3*a*, 3*b*, 3*c*, 3*d*, 3*e*, 3*f*, 3*g*, 3*h*, 3*i*, 3*j*, 3*k*, 3*m*, 3*n*, 3*p*, 3*q*, and 3*r* obtained by virtually dividing the guiding lens 3 with a plurality of planes containing the optical axis 1' of the light source 1. The angles of the respective divided portions 3*a*, 3*b*, 3*c*, 3*d*, 3*e*, 3*f*, 3*g*, 3*h*, 3*i*, 3*j*, 3*k*, 3*m*, 3*n*, 3*p*, 3*q*, and 3*r* centered on the optical axis 1' can each be set to 22.5 degrees.

Specifically, in the vehicular lamp 100 according to the second exemplary embodiment, the divided portion 3*a* can be formed, as shown in FIG. 20, from part of a rotational body as a basic block obtained by rotating a cross-sectional shape appearing on a plane S3*a* can be rotated around the optical axis 1' by 22.5 degrees. Further, the divided portion 3*b* can be formed from part of a rotational body as a basic block obtained by rotating a cross-sectional shape appearing on a plane S3*b* can be rotated around the optical axis 1' by 22.5 degrees. Further, the divided portion 3*c* can be formed from part of a rotational body as a basic block obtained by rotating a cross-sectional shape appearing on a plane S3*c* can be rotated around the optical axis 1' by 22.5 degrees. Further, the divided portion 3*d* can be formed from part of a rotational body as a basic block obtained by rotating a cross-sectional shape appearing on a plane S3*d* can be rotated around the optical axis 1' by 22.5 degrees. Further, the divided portion 3*e* can be formed from part of a rotational body as a basic block obtained by rotating a cross-sectional shape appearing on a plane S3*e* can be rotated around the optical axis 1' by 22.5 degrees. Further, the divided portion 3*f* can be formed from part of a rotational body as a basic block obtained by rotating a cross-sectional shape appearing on a plane S3*f* can be rotated around the optical axis 1' by 22.5 degrees. Further, the divided portion 3*g* can be formed from part of a rotational body as a basic block obtained by rotating a cross-sectional shape appearing on a plane S3*g* can be rotated around the optical axis 1' by 22.5 degrees. Further, the divided portion 3*h* can be formed from part of a rotational body as a basic block obtained by rotating a cross-sectional shape appearing on a plane S3*h* can be rotated around the optical axis 1' by 22.5 degrees.

In addition, in the vehicular lamp 100 according to the second exemplary embodiment, the divided portion 3*i* can be configured to be the same shape as the divided portion 3*a* such that the divided portions 3*i* and 3*a* are rotationally symmetric about the optical axis 1' by 180 degrees. Further, the divided portion 3*j* can be configured to be the same shape as the divided portion 3*b* such that the divided portions 3*j* and 3*b* are rotationally symmetric about the optical axis 1' by 180 degrees. Further, the divided portion 3*k* can be configured to be the same shape as the divided portion 3*c* such that the divided portions 3*k* and 3*c* are rotationally symmetric about the optical axis 1' by 180 degrees. Further, the divided portion 3*m* can be configured to be the same shape as the divided portion 3*d* such that the divided portions 3*m* and 3*d* are rotationally symmetric about the optical axis 1' by 180 degrees. Further, the divided portion 3*n* can be configured to be the same shape as the divided portion 3*e* such that the divided portions 3*n* and 3*e* are rotationally symmetric about the optical axis 1' by 180 degrees. Further, the divided portion 3*p* can be configured to be the same shape as the divided portion 3*f* such that the divided portions 3*p* and 3*f* are rotationally symmetric about the optical axis 1' by 180 degrees. Further, the divided portion 3*q* can be configured to be the same shape as the divided portion 3*g* such that the divided portions 3*q* and 3*g* are rotationally symmetric about the optical axis 1' by 180 degrees. Further, the divided portion 3*r* can be configured to be the same shape as the divided portion 3*h* such that the divided portions 3*r* and 3*h* are rotationally symmetric about the optical axis 1' by 180 degrees.

Figure 21:
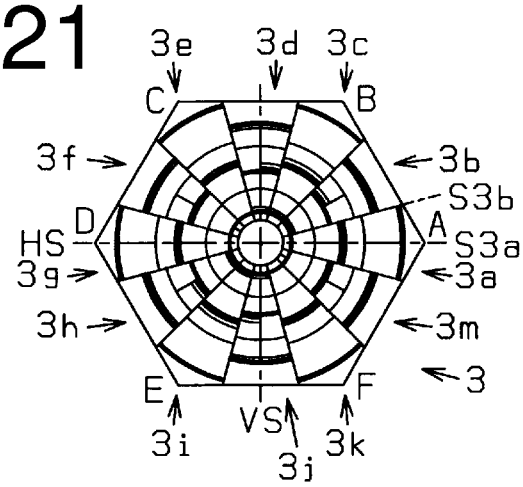
FIG. 21 is a front view showing the guiding lens of a vehicular lamp according to a third exemplary embodiment.

FIG. 21 is a front view showing the guiding lens 3 of a vehicular lamp according to a third exemplary embodiment.

The vehicular lamp 100 according to the first exemplary embodiment has the guiding lens 3 with the rectangular outline when viewed from the optical axis direction of the light source 1 as shown in FIG. 2A. Instead, the vehicular lamp 100 according to the third exemplary embodiment has the guiding lens 3 with the regular hexagon outline when viewed from the optical axis direction of the light source 1 as shown in FIG. 20.

Furthermore, in the vehicular lamp 100 according to the third exemplary embodiment, the guiding lens 3 can be configured to include a plurality of divided portions or 12 divided portions 3*a*, 3*b*, 3*c*, 3*d*, 3*e*, 3*f*, 3*g*, 3*h*, 3*i*, 3*j*, 3*k*, and 3*m* obtained by virtually dividing the guiding lens 3 with a plurality of planes containing the optical axis 1' of the light source 1. The angles of the respective divided portions 3*a*, 3*b*, 3*c*, 3*d*, 3*e*, 3*f*, 3*g*, 3*h*, 3*i*, 3*j*, 3*k*, and 3*m* centered on the optical axis 1' can each be set to 30 degrees.

Specifically, in the vehicular lamp 100 according to the third exemplary embodiment, the divided portion 3*a* can be formed, as shown in FIG. 21, from part of a rotational body as a basic block obtained by rotating a cross-sectional shape appearing on a plane S3*a* can be rotated around the optical axis 1' by 30 degrees. Further, the divided portion 3*b* can be formed, as shown in FIG. 21, from part of a rotational body as a basic block obtained by rotating a cross-sectional shape appearing on a plane S3*b* can be rotated around the optical axis 1' by 30 degrees.

In addition, in the vehicular lamp 100 according to the third exemplary embodiment, each of the divided portions 3*c*, 3*e*, 3*g*, 3*i*, and 3*k* can be configured to be almost the same shape as the divided portion 3*a* such that the divided portion 3*c*, 3*e*, 3*g*, 3*i*, or 3*k* and the divided portion 3*a* are rotationally symmetric about the optical axis 1' by 60×n degrees (n is a natural number). Further, each of the divided portions 3*d*, 3*f*, 3*h*, 3*j*, and 3*m* can be configured to be almost the same shape as the divided portion 3*b* such that the divided portion 3*d*, 3*f*, 3*h*, 3*j*, or 3*m* and the divided portion 3*b* are rotationally symmetric about the optical axis 1' by 60×n degrees (n is a natural number).

Accordingly, in other embodiments, the vehicular lamp according to the presently disclosed subject matter can have a guiding lens 3 with any appropriate polygonal outline when viewed from the optical axis direction of the light source 1. In this case, the respective sides of the polygon can correspond to the divided portions 3*a*, 3*b*, and so on.

Any of the above-described exemplary embodiments can be combined for constituting other vehicular lamps.

The vehicular lamp according to the presently disclosed subject matter can be applied not only to a headlamp, a front fog lamp, and the like, but also to a stop lamp, a rear lamp, a turn signal lamp, a rear fog lamp, a day-time travelling lamp, and the like.

It will be apparent to those skilled in the art that various modifications and variations can be made in the presently disclosed subject matter without departing from the spirit or scope of the presently disclosed subject matter. Thus, it is intended that the presently disclosed subject matter cover the modifications and variations of the presently disclosed subject matter provided they come within the scope of the appended claims and their equivalents. All related art references described above are hereby incorporated in their entirety by reference.

What is claimed is:

1. A vehicular lamp having an illumination direction comprising:

a light source having a light emitting device with an optical axis extending horizontally; and a guiding lens configured to guide light emitted from the light source and project the light in a direction of the optical axis of the light source, the guiding lens having a polygonal outline having N sides, where N is an integer greater than or equal to 3, when viewed from a front side in the direction of the optical axis of the light source, the polygonal outline being centered around the optical axis of the light source, the guiding lens including a plurality of divided portions obtained by virtually dividing the guiding lens with a plurality of planes containing the optical axis of the light source into n divided portions, where n is an integer larger than N, and setting angles of the respective divided portions centered around the optical axis of the light source, each of the divided portions of the guiding lens including a portion of a rotational body obtained by rotating around the optical axis a cross-sectional shape appearing on a plane containing the optical axis of the light source and a maximum radius portion of the divided portion farthest from the center, each of the divided portions of the guiding lens including:

a first incidence face on which light emitted from the light source at a first angle with respect to the optical axis of the light source is incident;

a first light-exiting face through which the light from the first incidence face passes and projects in the illumination direction of the vehicular lamp;

a second incidence face on which the light emitted from the light source at a second angle larger than the first angle with respect to the optical axis and the light emitted from the light source at a third angle larger than the second angle with respect to the optical axis is incident;

a first reflection face configured to reflect the light emitted from the light source at the second angle with respect to the optical axis and having passed through the second incidence face, in the direction of the optical axis of the light source;

a second light-exiting face through which the light from the first reflection face passes to be projected in the illumination direction of the vehicular lamp;

a second reflection face configured to reflect the light emitted from of the light source at the third angle with respect to the optical axis and having passed through the second incidence face, in the direction of the optical axis of the light source;

a third light-exiting face through which the light from the second reflection face passes to be projected in the illumination direction of the vehicular lamp;

a first connection face connecting the first reflection face with the second reflection face; and a second connection face connecting the second light-exiting face with the third light-exiting face, the second light-exiting face including an outer-diameter end disposed at a farthest position from the optical axis of the light source in the plane containing the optical axis of the light source and the maximum radius portion of the corresponding divided portion, wherein the divided portion that is located at the position within the horizontal plane containing the optical axis of the light source includes a third reflection face configured to reflect the light traveling from the second reflection face in the direction of the optical axis of the light source to guide the light at a certain angle with respect to the optical axis of the light source, and part of the light from the third reflection face of the divided portion that is located at the position within the horizontal plane containing the optical axis of the light source passes through the third light-exiting face so that it becomes rightward or leftward light traveling within the horizontal plane at 45 degrees with respect to the optical axis of the light source.

2. The vehicular lamp according to claim 1, wherein when a first sector is obtained by rotating a segment connecting the maximum radius portion of a first divided portion to the optical axis centered around the optical axis by 360/n degrees, and a second sector is obtained by rotating a segment connecting the maximum radius portion of a second divided portion adjacent the first divided portion to the optical axis centered around the optical axis by 360/n degrees, if a difference between the area of first sector and a projected area of the first divided portion when viewed from the front side in the direction of the optical axis is smaller than a difference between the area of second sector and a projected area of the second divided portion when viewed from the front side in the direction of the optical axis, the first reflection face of the first divided portion and the first reflection face of the second divided portion are configured such that a difference between a first angle and a second angle is smaller than a difference between a third angle and a fourth angle wherein the first angle is formed between the optical axis of the light source and the light incident on an outer-diameter end of the first reflection face of the first divided portion within the plane containing the maximum radius portion of the first divided portion and the optical axis of the light source, the second angle is formed between the optical axis of the light source and the light incident on an inner-diameter side end of the first reflection face of the first divided portion within the plane containing the maximum radius portion of the first divided portion and the optical axis of the light source, the third angle is formed between the optical axis of the light source and the light incident on an outer-diameter end of the first reflection face of the second divided portion within the plane containing the maximum radius portion of the second divided portion and the optical axis of the light source, and the fourth angle is formed between the optical axis of the light source and the light incident on an inner-diameter end of the first reflection face of the second divided portion within the plane containing the maximum radius portion of the second divided portion and the optical axis of the light source.

3. The vehicular lamp according to claim 1, wherein the first incidence faces are each formed from a plane obtained by rotating a curve around the optical axis of the light source by 360 degrees, the first light-exiting face are each configured such that light emitted upward from the light source at first angle greater than zero with respect to the optical axis of the light source passes through the first incidence face and the first light-exiting face of one divided portion that is located at a position including a vertical plane containing the optical axis of the light source so that the exiting light becomes upward light at a second angle greater than zero and less than the first angle with respect to the optical axis of the light source, such that light emitted downward from the light source at the first angle with respect to the optical axis of the light source passes through the first incidence face and the first light-exiting face of one divided portion that is located at a position including the vertical plane containing the optical axis of the light source so that the exiting light becomes downward light at the second angle with respect to the optical axis of the light source, such that light emitted rightward from the light source at the first angle with respect to the optical axis of the light source passes through the first incidence face and the first light-exiting face of one divided portion that is located at a position including a horizontal plane containing the optical axis of the light source so that the exiting light becomes rightward light at a third angle greater than the second angle with respect to the optical axis of the light source, and such that light emitted leftward from the light source at the first angle with respect to the optical axis of the light source passes through the first incidence face and the first light-exiting face of one divided portion that is located at a position including the horizontal plane containing the optical axis of the light source so that the exiting light becomes leftward light at the third angle with respect to the optical axis of the light source.

4. The vehicular lamp according to claim 2, wherein the first incidence faces are each formed from a plane obtained by rotating a curve around the optical axis of the light source by 360 degrees, the first light-exiting faces are each configured such that light emitted upward from the light source at first angle θ greater than zero with respect to the optical axis of the light source passes through the first incidence face and the first light-exiting face of one divided portion that is located at a position including a vertical plane containing the optical axis of the light source so that the exiting light becomes upward light at second angle greater than zero and less than the first angle with respect to the optical axis of the light source, such that light emitted downward from the light source at the first angle with respect to the optical axis of the light source passes through the first incidence face and the first light-exiting face of one divided portion that is located at a position including the vertical plane containing the optical axis of the light source so that the exiting light becomes downward light at the second angle with respect to the optical axis of the light source, such that light emitted rightward from the light source at the first angle with respect to the optical axis of the light source passes through the first incidence face and the first light-exiting face of one divided portion that is located at a position including a horizontal plane containing the optical axis of the light source so that the exiting light becomes rightward light at third angle greater than the second angle with respect to the optical axis of the light source, and such that light emitted leftward from the light source at the first angle with respect to the optical axis of the light source passes through the first incidence face and the first light-exiting face of one divided portion that is located at a position including the horizontal plane containing the optical axis of the light source so that the exiting light becomes leftward light at the third angle with respect to the optical axis of the light source.

5. The vehicular lamp according to claim 1, wherein the polygonal outline includes one of a rectangular outline, a parallelogram outline and a hexagonal outline.

6. The vehicular lamp according to claim 1, wherein each first reflection face is spaced from the optical axis by a radial distance that is different from a radial distance of the first reflection face of an adjacent divided portion.

7. The vehicular lamp according to claim 1, wherein each second reflection face is spaced from the optical axis by a radial distance that is different from a radial distance of the second reflection face of an adjacent divided portion.

8. The vehicular lamp according to claim 1, wherein second light-exiting face is spaced from the optical axis by a radial distance that is different from a radial distance of the second light-exiting face of an adjacent divided portion.

9. The vehicular lamp according to claim 1, wherein third light-exiting face is spaced from the optical axis by a radial distance that is different from a radial distance of the third light-exiting face of an adjacent divided portion.

10. The vehicular lamp according to claim 1, wherein the guiding lens including a plurality of divided portions is obtained by virtually dividing the guiding lens with a plurality of planes containing the optical axis of the light source into n divided portions, where n is an integer larger than N, and the angles of the respective divided portions centered around the optical axis of the light is 360/n degrees.

* * * * *